US012734641B2

(12) United States Patent
Kodama

(10) Patent No.: US 12,734,641 B2
(45) Date of Patent: Sep. 15, 2026

(54) GRINDING APPARATUS

(71) Applicant: Tokyo Electron Limited, Tokyo (JP)

(72) Inventor: Munehisa Kodama, Kikuchi-gun (JP)

(73) Assignee: Tokyo Electron Limited, Tokyo (JP)

( * ) Notice: Subject to any disclaimer, the term of this patent is extended or adjusted under 35 U.S.C. 154(b) by 601 days.

(21) Appl. No.: 18/246,517

(22) PCT Filed: Sep. 13, 2021

(86) PCT No.: PCT/JP2021/033569
§ 371 (c)(1),
(2) Date: Mar. 24, 2023

(87) PCT Pub. No.: WO2022/065111
PCT Pub. Date: Mar. 31, 2022

(65) Prior Publication Data

US 2023/0364740 A1 Nov. 16, 2023

(30) Foreign Application Priority Data

Sep. 25, 2020 (JP) ..... 2020-161264

(51) Int. Cl.
*B24B 57/02* (2006.01)
*B24B 49/18* (2006.01)

(52) U.S. Cl.
CPC ..... *B24B 57/02* (2013.01); *B24B 49/18* (2013.01)

(58) Field of Classification Search
CPC ..... B24B 49/18; B24B 57/02; B24B 7/228; B24B 49/08; B24B 49/12; B24B 55/12
USPC ..... 451/1, 6, 283, 285, 287
See application file for complete search history.

(56) References Cited

U.S. PATENT DOCUMENTS 5,804,507 A * 9/1998 Perlov ..... B24B 37/04 438/692
2002/0085447 A1* 7/2002 Snyder ..... B01F 35/82 366/136
2005/0118938 A1* 6/2005 Mizomoto ..... B24B 37/345 451/65
2014/0248782 A1* 9/2014 Ishibashi ..... B24B 37/34 438/746

(Continued)

FOREIGN PATENT DOCUMENTS

CN 208759301 U 4/2019
JP 2010-124006 A 6/2010

(Continued)

OTHER PUBLICATIONS

International Search Report of PCT/JP2021/033569 dated Nov. 16, 2021.

*Primary Examiner* — Joseph A Stoklosa
(74) *Attorney, Agent, or Firm* — Shih IP Law Group, PLLC.

(57) ABSTRACT

A grinding apparatus includes a chuck, a housing, a tool driving unit, a nozzle, a sensor and a sensor cover. The chuck is configured to hold a substrate. The housing accommodates the chuck therein. The tool driving unit is configured to drive a grinding tool pressed against the substrate within the housing. The nozzle is configured to supply a grinding liquid to the substrate within the housing. The sensor is disposed at an inside of the housing and is configured to detect a liquid level of a liquid collected within the housing. The sensor cover is located between the chuck and the sensor.

9 Claims, 15 Drawing Sheets

(56) References Cited

U.S. PATENT DOCUMENTS

| | | | | |
|---|---|---|---|---|
| 2019/0299360 | A1* | 10/2019 | Sone | B24B 57/02 |
| 2020/0049546 | A1* | 2/2020 | Toyomura | B24B 37/34 |

FOREIGN PATENT DOCUMENTS

| | | | | | |
|---|---|---|---|---|---|
| JP | 2012121085 | A | * | 6/2012 | |
| JP | 2013-188813 | A | | 9/2013 | |
| JP | 2017-222015 | A | | 12/2017 | |
| JP | 2019185645 | A | * | 10/2019 | |
| KR | 20170070888 | A | * | 6/2017 | H01L 21/67051 |

* cited by examiner

GRINDING APPARATUS

CROSS-REFERENCE TO RELATED APPLICATIONS

This Application is a U.S. national phase application under 35 U.S.C. § 371 of PCT Application No. PCT/JP2021/033569 filed on Sep. 13, 2021, which claims the benefit of Japanese Patent Application No. 2020-161264 filed on Sep. 25, 2020, the entire disclosures of which are incorporated herein by reference.

TECHNICAL FIELD

The various aspects and embodiments described herein pertain generally to a grinding apparatus.

BACKGROUND

A processing apparatus described in Patent Document 1 includes a turntable, a pair of holding tables, a processing device, and a water case. The water case has an opening through which the turntable is exposed, and serves to receive a processing waste liquid flowing down from the turntable and containing a processing residue produced as a result of processing a target object to drain the received processing waste liquid from a drain port.

A grinding apparatus described in Patent Document 2 includes a holding table, a grinding device configured to perform grinding by supplying grinding water, a turntable having two or more holding tables provided at an equal angle around a rotation axis, and a table cover covering a top surface of the turntable. A top surface of the table cover is inclined downwards as it goes outwards from the rotation axis. The grinding water is drained from an outlet of the water case. A net is set at the outlet of the water case to collect a grinding residue mixed in the grinding water. The grinding residue is appropriately removed from the net.

A plane processing apparatus described in Patent Document 3 has a partition plate. The partition plate is fixed to an index table and formed in a cross shape so as to divide four chucks provided on the index table. The plane processing apparatus has a casing accommodating therein the chucks and the index table, and grinds a substrate with a whetstone within the casing while supplying a grinding liquid to the substrate. Brushes are mounted to a top surface and a side surface of the casing. The brushes come into contact with a top surface and a side surface of the partition plate when the chuck is placed at a processing position.

PRIOR ART DOCUMENT

Patent Document 1: Japanese Patent Laid-open Publication No. 2017-222015

Patent Document 2: Japanese Patent Laid-open Publication No. 2013-188813

Patent Document 3: Japanese Patent Laid-open Publication No. 2010-124006

DISCLOSURE OF THE INVENTION

Means for Solving the Problems

In an exemplary embodiment, a grinding apparatus includes a chuck, a housing, a tool driving unit, a nozzle, a sensor and a sensor cover. The chuck is configured to hold a substrate. The housing accommodates the chuck therein.

The tool driving unit is configured to drive a grinding tool pressed against the substrate within the housing. The nozzle is configured to supply a grinding liquid to the substrate within the housing. The sensor is disposed at an inside of the housing and is configured to detect a liquid level of a liquid collected within the housing. The sensor cover is located between the chuck and the sensor.

DETAILED DESCRIPTION

Figure 1:
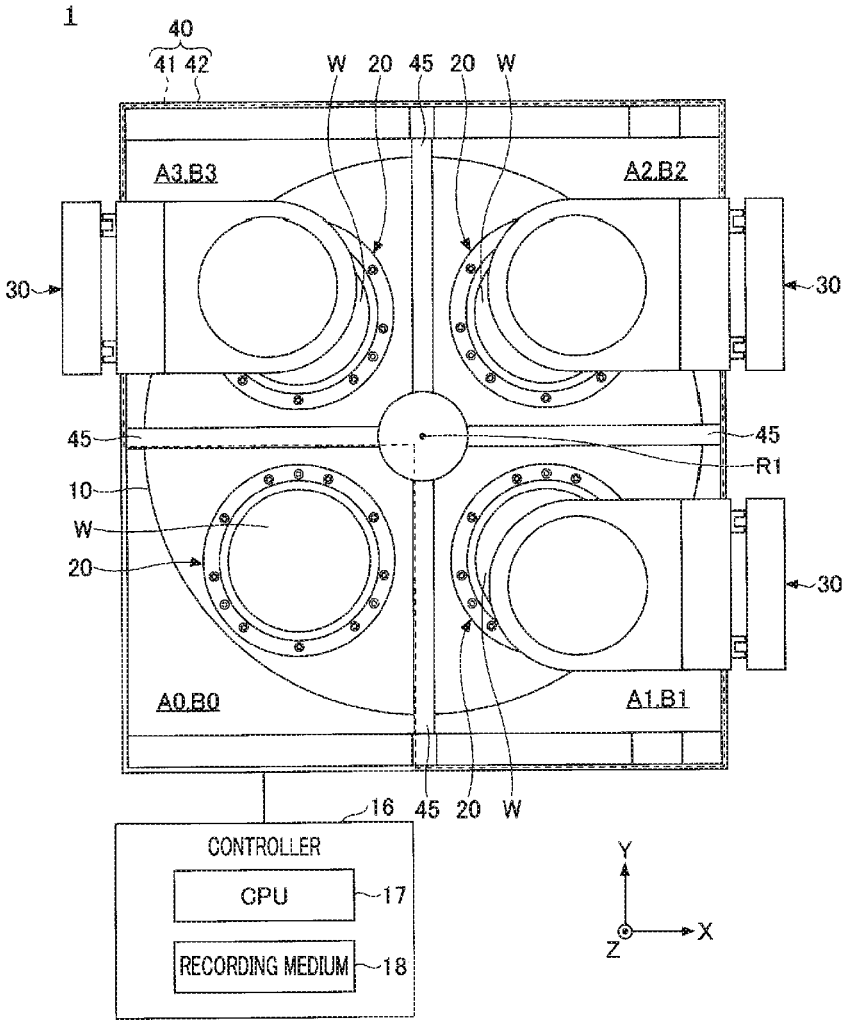
FIG. 1 is a plan view showing a grinding apparatus according to an exemplary embodiment, which is seen through a top panel of a housing.

Hereinafter, exemplary embodiments of the present disclosure will be described with reference to the accompanying drawings. Further, in the various drawings, same or corresponding parts will be assigned same reference numerals, and redundant description will sometimes be omitted. In the present specification, the X-axis direction, the Y-axis direction and the Z-axis direction are orthogonal to each other. The X-axis and Y-axis directions are horizontal directions, and the Z-axis direction is a vertical direction.

First, referring to FIG. 1, a grinding apparatus 1 will be described. The grinding apparatus 1 is configured to grind a substrate W. The substrate W includes a semiconductor substrate such as a silicon wafer or a compound semiconductor wafer, or a glass substrate. The substrate W may further include a device layer formed on a surface of the semiconductor substrate or the glass substrate. The device layer includes an electronic circuit. Further, the substrate W may be a combined substrate in which multiple substrates are bonded. Grinding includes polishing. The grinding apparatus 1 includes, for example, a table 10, four chucks 20, three tool driving units 30, a housing 40, and a controller 16.

The controller 16 is, for example, a computer, and includes a CPU (Central Processing Unit) 17 and a recording medium 18 such as a memory. The recording medium 18 stores therein a program for controlling various kinds of processings performed in the grinding apparatus 1. The controller 16 controls an operation of the grinding apparatus 1 by causing the CPU 17 to execute the program stored in the recording medium 18.

The table 10 holds the four chucks 20 around a rotation center line R1, and is configured to be rotated around the rotation center line R1. When viewed from above, the rotation direction of the table 10 is switched between a clockwise direction and a counterclockwise direction.

The four chucks 20 are arranged at an equal interval around the rotation center line R1 of the table 10. Each chuck 20 is rotated along with the table 10, and is moved to a carry-in/out position A0, a first grinding position A1, a second grinding position A2, a third grinding position A3, and back to the carry-in/out position A0 in this order.

The carry-in/out position A0 is a position where a carry-in/out of the substrate W to/from the chuck 20 is performed, and serves as both a carry-in position where the substrate W is carried in and a carry-out position where the substrate W is carried out. The first grinding position A1 is a position where first grinding of the substrate W is performed. The second grinding position A2 is a position where second grinding of the substrate W is performed. The third grinding position A3 is a position where third grinding of the substrate W is performed. Further, in the present exemplary embodiment, although the carry-in position and the carry-out position are same, they may be different.

Figure 2:
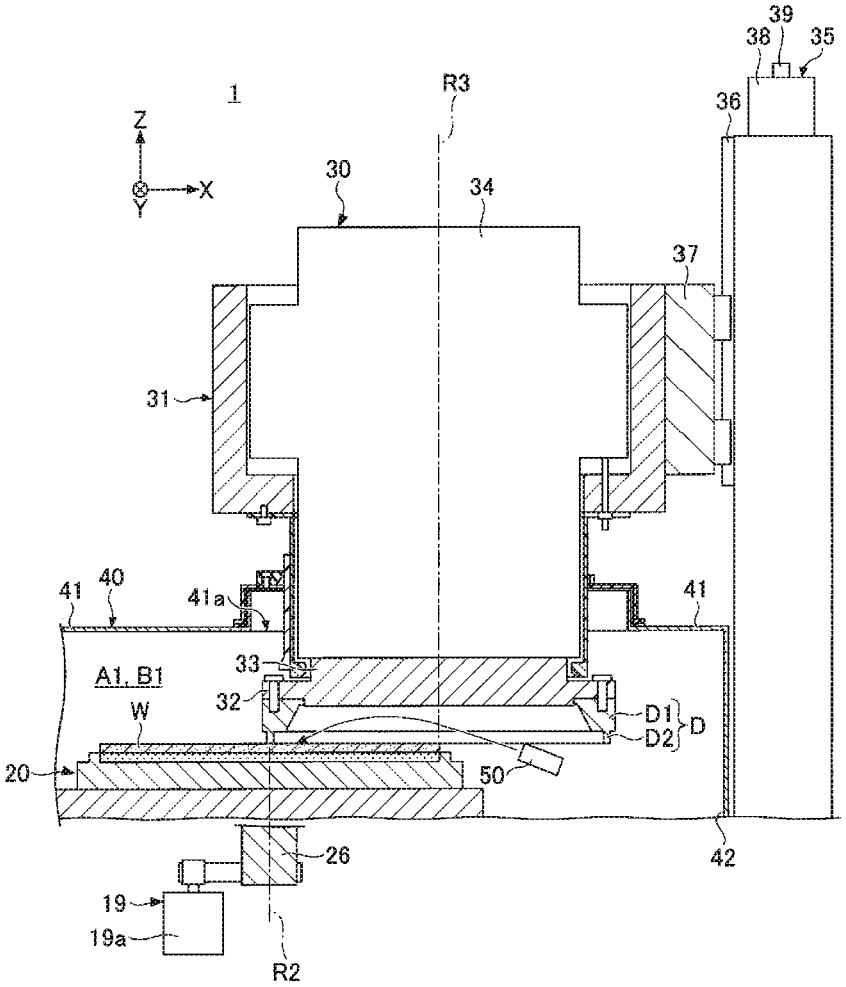
FIG. 2 is a cross sectional view illustrating an example of a tool driving unit.

The four chucks 20 are mounted to the table 10 so as to be rotatable about their own rotation center lines R2 (see FIG. 2). For each chuck 20, a chuck driving unit 19 configured to drive the chuck 20 is provided.

The chuck driving unit 19 includes, for example, a motor 19*a* configured to rotate the chuck 20. A rotational driving force of the motor 19*a* is transmitted to the chuck 20 via a timing belt or the like. Here, a gear may be used instead of the timing belt.

One of the tool driving unit 30 drives a grinding tool D for the first grinding. This tool driving unit 30 rotates the grinding tool D or moves it up and down. Another tool driving unit 30 drives a grinding tool D for the second grinding. The other tool driving unit 30 drives a grinding tool D for the third grinding.

Now, the tool driving unit 30 will be described with reference to FIG. 2. The tool driving unit 30 includes a moving unit 31 to which the grinding tool D is mounted. The grinding tool D is pressed against the substrate W to grind the substrate W. The grinding tool D includes, for example, a disk-shaped grinding wheel D1 and a plurality of whetstones D2 arranged in a ring shape on a bottom surface of the grinding wheel D1.

The moving unit 31 includes a flange 32 to which the grinding tool D is mounted, a spindle shaft 33 having the flange 32 at a lower end thereof, and a spindle motor 34 configured to rotate the spindle shaft 33. The flange 32 is disposed horizontally, and the grinding tool D is mounted to a bottom surface thereof. The spindle shaft 33 is vertically disposed. The spindle motor 34 is configured to rotate the spindle shaft 33, thus allowing the grinding tool D mounted on the flange 32 to be rotated. A rotation center line R3 of the grinding tool D coincides with a rotation center line of the spindle shaft 33.

The tool driving unit 30 further includes an elevating unit 35 configured to move the moving unit 31 up and down. The elevating unit 35 has, for example, a vertical Z-axis guide 36, a Z-axis slider 37 configured to be moved along the Z-axis guide 36, and a Z-axis motor 38 configured to move the Z-axis slider 37. The moving unit 31 is fixed to the Z-axis slider 37, and the moving unit 31 and the grinding tool D are moved up and down along with the Z-axis slider 37. The elevating unit 35 further includes a position detector 39 configured to detect the position of the grinding tool D. By way of example, the position detector 39 detects a rotation of the Z-axis motor 38 to detect the position of the grinding tool D.

The elevating unit 35 lowers the grinding tool D from a standby position. The grinding tool D is rotated while being lowered, comes into contact with a top surface of the substrate W being rotated, and grinds the entire top surface of the substrate W. When the thickness of the substrate W reaches a set value, the elevating unit 35 stops the lowering of the grinding tool D. Thereafter, the elevating unit 35 raises the grinding tool D up to the standby position.

The grinding apparatus 1 includes a housing 40 accommodating a plurality of chucks 20 therein. The housing 40 suppresses a grinding residue and a grinding liquid from being scattered to the outside. The grinding residue is powder or fragments as a result of grinding the substrate W. The powder includes powder scraped off from the substrate W and abrasive grains separated from the grinding tool D. The fragments are, for example, circular arc-shaped flakes formed at a periphery of the substrate W. The housing 40 may accommodate therein the table 10 as well.

The housing 40 has a top panel 41 located above the chuck 20; and a side panel 42 located on the side of the chuck 20. The top panel 41 is horizontal, whereas the side panel 42 is vertical. The top panel 41 is located above the side panel 42. An insertion opening 41*a* for the moving unit 31 is formed at the top panel 41.

As shown by a dashed line in FIG. 1, the top panel 41 covers, for example, a space above the first grinding position A1, the second grinding position A2, and the third grinding position A3. Moreover, the top panel 41 opens a space above the carry-in/out position A0. By way of example, when viewed from above, the top panel 41 has a shape in which one corner of a rectangle is notched in an L shape.

As depicted in FIG. 2, the grinding apparatus 1 is equipped with a nozzle 50 configured to supply a grinding liquid to the substrate W held by the chuck 20. The grinding liquid is, for example, pure water such as DIW (Deionized Water). The grinding liquid enters a gap between the substrate W and the grinding tool D, and reduces grinding resistance to suppress heat generation. The nozzle 50 may supply the pure water as a cleaning liquid to the chuck 20 from which the substrate W has been carried-out.

As illustrated in FIG. 1, the grinding apparatus 1 is equipped with a fixed partition wall 45 that divides the inside of the housing 40 into a plurality of chambers around the rotation center line R1 of the table 10. The fixed partition wall 45 is fixed to a bottom surface of the top panel 41. When viewed from above, the fixed partition wall 45 extends in a radial direction (a direction orthogonal to the rotation center line R1) of the table 10.

The fixed partition wall 45 is formed in, for example, a cross shape, and divides the inside of the housing 40 into four rooms B0 to B3 around the rotation center line R1 of the table 10. The three rooms B1 to B3 are grinding chambers in which grinding of the substrate W is performed. The room B1 is a first grinding chamber; B2, a second grinding chamber; and B3, a third grinding chamber. The remaining one room B0 is a carry-in/out chamber in which the carry-in/out of the substrate W is performed. The carry-in/out of the substrate W includes a handover of the substrate W between an external transfer device and the chuck 20.

When viewed from above, the inside of the housing 40 is partitioned into the carry-in/out chamber B0, the first grinding chamber B1, the second grinding chamber B2, and the third grinding chamber B3 in this order in the counterclockwise direction. Here, the order of the four rooms B0 to B3 may be reversed, so when viewed from above, the inside of the housing 40 may be partitioned into the carry-in/out chamber B0, the first grinding chamber B1, the second grinding chamber B2, and the third grinding chamber B3 in this order in the clockwise direction.

Figure 3:
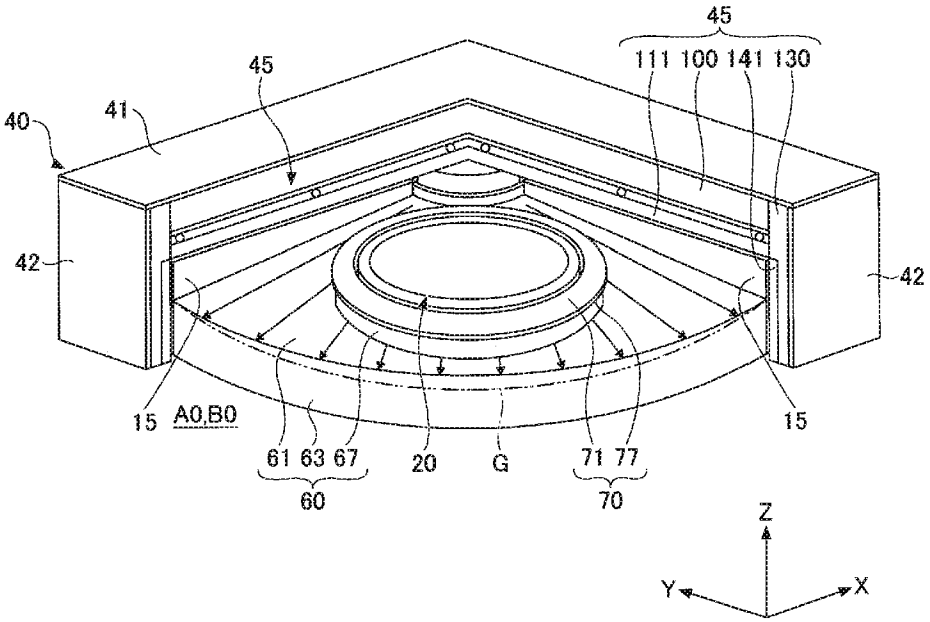
FIG. 3 is a perspective view illustrating an example of a carry-in/out chamber of the housing.

As shown in FIG. 3, the grinding apparatus 1 includes a plurality of rotary partition walls 15 configured to be rotated along with the table 10. Each of the rotary partition walls 15 is located between the chucks 20 adjacent to each other in a circumferential direction of the table 10, rotated along with the table 10, stopped directly under the fixed partition wall 45, and comes into contact with a lower end of the fixed partition wall 45. The fixed partition wall 45 and the rotary partition wall 15 suppress movement of the grinding residue and the grinding liquid between the neighboring rooms. In addition, an upper end of the rotary partition wall 15 and the lower end of the fixed partition wall 45 do not need to be in contact with each other.

For example, the fixed partition wall 45 and the rotary partition wall 15 suppress the grinding residue or the like from reaching the carry-in/out chamber B0 from the first grinding chamber B1 and the third grinding chamber B3, thus allowing the carry-in/out chamber B0 to be maintained clean. Moreover, the fixed partition wall 45 and the rotary partition wall 15 also suppress a first grinding residue having a large particle diameter from entering the second grinding chamber B2 from the first grinding chamber B1, thus suppressing a ground surface of the substrate W after being subjected to the second grinding from being roughened. In addition, the fixed partition wall 45 and the rotary partition wall 15 further suppress a second grinding residue having a large particle size from entering the third grinding chamber B3 from the second grinding chamber B2, thus suppressing the ground surface after being subjected to the third grinding from being roughened.

As depicted in FIG. 4A to FIG. 4D, the fixed partition wall 45 includes an upper wall 100 extending in the radial direction of the table 10 (Y-axis direction in FIG. 4A to FIG. 4D); a first upper sheet 111 suspended from the upper wall 100 along the upper wall 100; and a second upper sheet 112 facing the first upper sheet 111 at a certain distance therebetween. The first upper sheet 111 and the second upper sheet 112 are, for example, resin sheets or rubber sheets.

Unlike the brush described in Patent Document 3, the first upper sheet 111 and the second upper sheet 112 are not lines but planes, and they inhibit the movement of the grinding residue and the grinding liquid. In addition, the first upper sheet 111 and the second upper sheet 112 doubly inhibit the movement of the grinding residue and the grinding liquid. Therefore, it is possible to inhibit the movement of the grinding residue and the grinding liquid between the adjacent chambers more effectively than in the conventional cases.

Figure 4A:
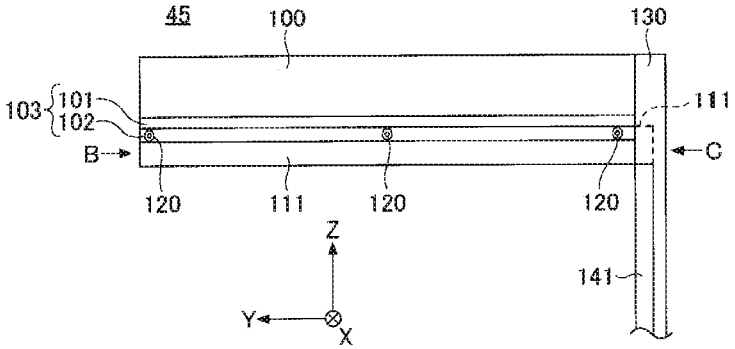
FIG. 4A is a diagram illustrating an example of a fixed partition wall.
Figure 4B:
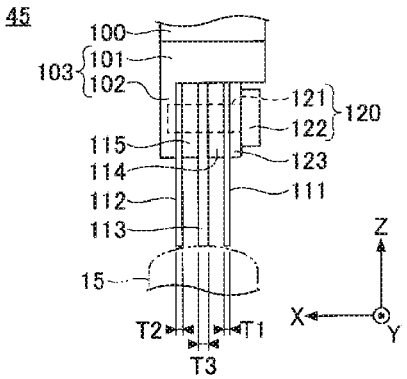
FIG. 4B is a diagram seen from the direction of an arrow B of FIG. 4A.

As shown in FIG. 4B, the upper wall 100 has, at its lower end, a horizontal member 101 extending in the radial direction of the table 10, and a vertical member 102 protruding downwards from one end of the horizontal member 101 in a width direction thereof. The horizontal member 101 and the vertical member 102 form an L-shaped angle 103. The fixed partition wall 45 has a fastener configured to fasten the first upper sheet 111 and the second upper sheet 112 to the vertical member 102. Although not particularly limited, the fastener may be a bolt 120.

A plurality of bolts 120 are provided at a certain interval therebetween in the radial direction of the table 10. A shaft member 121 of the bolt 120 is screwed into a bolt hole of the vertical member 102 through a through hole of the first upper sheet 111 and a through hole of the second upper sheet 112. A head 122 of the bolt 120 presses the first upper sheet 111 and the second upper sheet 112 via a pressing plate 123 or the like.

By loosening or tightening the bolts 120, the first upper sheet 111 or the second upper sheet 112 can be replaced. Before and after the replacement of the first upper sheet 111, it is also possible to change the size or shape of the first upper sheet 111. The same goes for the second upper sheet 112.

When viewed from above, the first upper sheet 111, the second upper sheet 112, and the head 122 of the bolt 120 do not protrude from the horizontal member 101. Thus, interference between the head 122 of the bolt 120 and the like and other members can be suppressed.

The first upper sheet 111 and the second upper sheet 112 are arranged with spacers 114 and 115 therebetween, and are protruded downwards below the spacers 114 and 115. Each of the spacers 114 and 115 is provided with a through hole through which the shaft member 121 of the bolt 120 passes.

The fixed partition wall 45 may further include a third upper sheet 113 disposed between the first upper sheet 111 and the second upper sheet 112. The third upper sheet 113 is, for example, a resin sheet or a rubber sheet. The first upper sheet 111, the second upper sheet 112, and the third upper sheet 113 inhibit the movement of the grinding residue and the grinding liquid triply.

The third upper sheet 113 and the first upper sheet 111 are disposed with the spacer 114 therebetween, and are protruded downwards below the spacer 114. Further, the third upper sheet 113 and the second upper sheet 112 are disposed with the spacer 115 therebetween, and are protruded downwards below the spacer 115.

As indicated by a dashed double-dotted line in FIG. 4B, an upper end of the rotary partition wall 15 may have an upwardly protruding curved surface when viewed from the radial direction of the table 10. The third upper sheet 113 is in contact with the upper end of the rotary partition wall 15. On the other hand, the first upper sheet 111 and the second upper sheet 112 are not in contact with the upper end of the rotary partition wall 15.

The third upper sheet 113 is in contact with the upper end of the rotary partition wall 15. Therefore, a thickness T3 of the third upper sheet 113 may be larger than a thickness T1 of the first upper sheet 111 and a thickness T2 of the second upper sheet 112. With this configuration, it is possible to achieve both durability of the third upper sheet 113 and flexibility of the first upper sheet 111 and the second upper sheet 112. Alternatively, the first upper sheet 111 and the second upper sheet 112 may be in contact with the upper end of the rotary partition wall 15 and transformed to conform to the upper end thereof.

Further, a member other than the third upper sheet 113, such as a brush, may be disposed between the first upper sheet 111 and the second upper sheet 112. Further, neither the third upper sheet 113 nor a brush needs to be disposed between the first upper sheet 111 and the second upper sheet 112, and nothing needs to be disposed therebetween. Various seal members can be attached in a replaceable manner by using the bolts 120, and the number of those seal members can be changed. When there is no third upper sheet 113, either or both of the first upper sheet 111 and the second upper sheet 112 may be in contact with the upper end of the rotary partition wall 15. Alternatively, when the third upper sheet 113 is not present, neither the first upper sheet 111 nor the second upper sheet 112 may need to be in contact with the upper end of the rotary partition wall 15.

The fixed partition wall 45 includes a sidewall 130 located between the upper wall 100 and the side panel 42 and protruding downwards below the upper wall 100; a first transverse sheet 141 protruding from the sidewall 130 toward the table 10; and a second transverse sheet 142 facing the first transverse sheet 141 at a certain distance therebetween. The first transverse sheet 141 and the second transverse sheet 142 are, for example, resin sheets or rubber sheets.

Figure 4C:
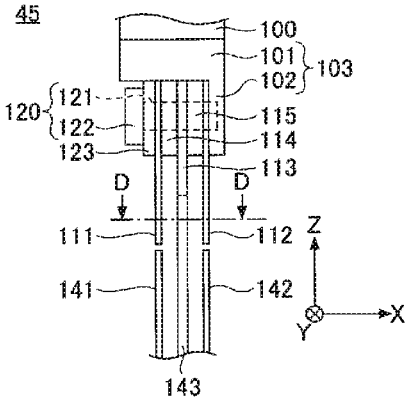
FIG. 4C is a diagram seen through a sidewall from the direction of an arrow C of FIG. 4A.

As shown in FIG. 4C, the first transverse sheet 141 is arranged on the same plane as the first upper sheet 111, for example. The thickness of the first transverse sheet 141 may be equal to the thickness T1 of the first upper sheet 111. Further, the second transverse sheet 142 is arranged on the same plane as the second upper sheet 112, for example. The thickness of the second transverse sheet 142 may be equal to the thickness T2 of the second upper sheet 112.

Unlike the brush described in Patent Document 3, the first transverse sheet 141 and the second transverse sheet 142 are not lines but planes, and they inhibit the movement of the grinding residue and the grinding liquid. Moreover, the first transverse sheet 141 and the second transverse sheet 142 doubly inhibit the movement of the grinding residue and the grinding liquid. Therefore, it is possible to inhibit the movement of the grinding residue and the grinding liquid between adjacent chambers more effectively than in the conventional cases.

The fixed partition wall 45 may further include a third transverse sheet 143 disposed between the first transverse sheet 141 and the second transverse sheet 142. The third transverse sheet 143 is, for example, a resin sheet or a rubber sheet.

The third transverse sheet 143 is arranged on the same plane as the third upper sheet 113, for example. The thickness of the third transverse sheet 143 may be equal to the thickness T3 of the third upper sheet 113. The thickness of the third transverse sheet 143 is larger than the thickness of the first transverse sheet 141 and the thickness of the second transverse sheet 142.

As shown in FIG. 4C, the third transverse sheet 143 protrudes upwards to be higher than the first transverse sheet 141 and the second transverse sheet 142, and is inserted between the first upper sheet 111 and the second upper sheet 112. As a result, even if there is a gap between the first upper sheet 111 and the first transverse sheet 141, the gap can be closed with the third transverse sheet 143, so that the grinding residue and the grinding liquid can be suppressed from being moved through the gap. Likewise, even if there is a gap between the second upper sheet 112 and the second transverse sheet 142, the gap can be closed with the third transverse sheet 143, so that the grinding residue and the grinding liquid can be suppressed from being moved through the gap.

Figure 4D:
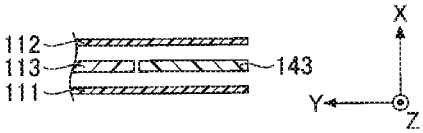
FIG. 4D is a cross sectional view taken along a line D-D of FIG. 4C.

As illustrated in FIG. 4D, the first upper sheet 111 and the second upper sheet 112 protrude toward the sidewall 130 more than the third upper sheet 113. As a result, even if there is a gap between the third upper sheet 113 and the third transverse sheet 143, the gap can be hidden by the first upper sheet 111 and the second upper sheet 112, so that the movement of the grinding residue and the grinding liquid through this gap can be suppressed.

Figure 5:
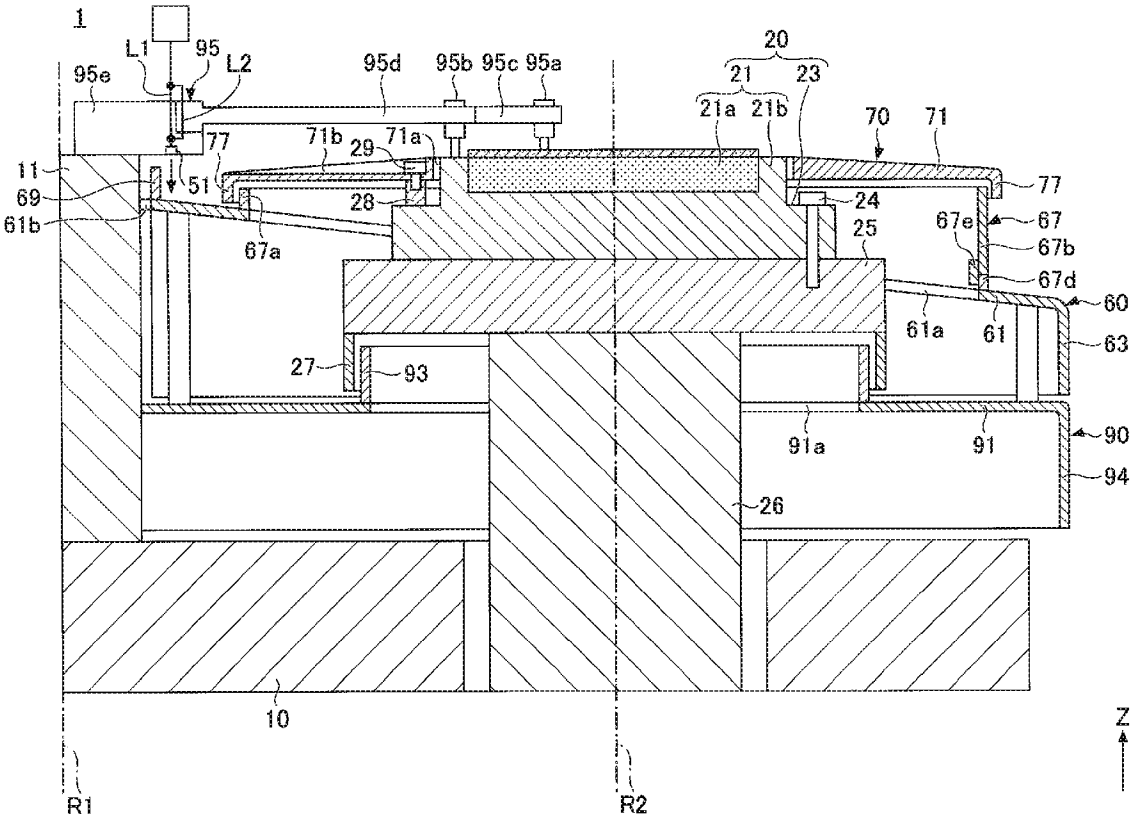
FIG. 5 is a cross sectional view illustrating a chuck cover, a table cover, and a base cover.

Now, referring to FIG. 5, a chuck cover 70 and the like will be explained. As depicted in FIG. 5, the grinding apparatus 1 is equipped with the chuck cover 70 configured to be rotated along with the chuck 20. The chuck 20 includes a holding table 21 configured to hold the substrate W, and a flange 23 provided at a lower edge of the holding table 21. The holding table 21 has a porous body 21*a* and a base 21*b*. A recess is formed in a top surface of the base 21*b*, and the porous body 21*a* having a disk shape is embedded in the recess.

When a gas inside the porous body 21*a* is sucked so that the pressure of the porous body 21*a* becomes a negative pressure lower than the atmospheric pressure, the substrate W is attracted to the porous body 21*a*. Meanwhile, when the sucking of the gas is stopped so that the pressure of the porous body 21*a* is returned to the atmospheric pressure, the attraction of the substrate W is released.

The chuck 20 is disposed on the rotary table 25, and is fixed to the rotary table 25 with a fastener. Although the fastener is not particularly limited, it may be, by way of example, bolts 24. The plurality of bolts 24 are arranged at a distance therebetween in the circumferential direction of the flange 23 of the chuck 20. A shaft portion of the bolt 24 is screwed into a bolt hole of the rotary table 25 through a through hole of the flange 23. A head portion of the bolt 24 presses the flange 23 from above. By loosening or tightening the bolt 24, the chuck 20 can be replaced.

The chuck cover 70 includes an annular overhanging member 71. The annular overhanging member 71 is provided with, in the center thereof, an opening 71*a* into which the holding table 21 of the chuck 20 is inserted. A top surface of the overhanging member 71 is on a level with or lower than a top surface of the holding table 21 of the chuck 20. In addition, the top surface of the overhanging member 71 is disposed above an inclined member 61 of a table cover 60 to be described later.

The top surface of the overhanging member 71 is inclined downwards as it goes away from the rotation center line R2 of the chuck 20. Further, the top surface of the overhanging member 71 may be horizontal. However, if the top surface of the overhanging member 71 is inclined, the grinding liquid can be drained obliquely downwards by gravity, so that the deposition of the grinding residues mixed with the grinding liquid can be suppressed. The top surface of the overhanging member 71 has, by way of non-limiting example, a conical shape.

The overhanging member 71 is disposed above the flange 23 of the chuck 20, and covers the bolt 24 serving as the fastener from above. The diameter of the opening 71*a* formed in the center of the overhanging member 71 is larger than the diameter of the holding table 21 and smaller than the diameter of the flange 23. The bolt 24 can be hidden directly below the overhanging member 71, and it is possible to suppress the grinding liquid from colliding with the bolt 24. Therefore, the scattering of the grinding liquid can be suppressed.

According to the present exemplary embodiment, the chuck cover 70 is rotated along with the chuck 20. If the chuck 20 is rotated at the time of performing the grinding of the substrate W, the overhanging member 71 is rotated, and the grinding liquid adhering to the overhanging member 71 can be blown radially outwards by a centrifugal force. Therefore, the deposition of the grinding residues mixed with the grinding liquid can be suppressed, and the deposition of the grinding residues near the chuck 20 can be suppressed. As a result, it is possible to suppress the contamination of the operator or the work robot during the maintenance such as replacement of the chuck 20 or the grinding tool D. In addition, it is possible to suppress the accumulated grinding residues from being peeled off and adhering to the chuck 20 or the substrate W.

A spacer 28 is provided between the overhanging member 71 of the chuck cover 70 and the flange 23 of the chuck 20. The spacer 28 is plural in number, and the plurality of spacers 28 are provided at a distance therebetween in the circumferential direction of the flange 23. The overhanging member 71 is disposed on top of the plurality of spacers 28. Further, the spacer 28 may be integrated as one body with the overhanging member 71. In that case, the spacer 28 is disposed on the flange 23, and a shaft portion of a bolt 29 to be described later is screwed into a bolt hole of the flange 23.

The spacer 28 forms a gap between the overhanging member 71 and the flange 23. As compared to a case where there is no gap, the thickness of the overhanging member 71 can be made small, and the overhanging member 71 can be reduced in weight. Moreover, a space for accommodating a head portion of the bolt 24 can be secured between the overhanging member 71 and the flange 23.

The spacer 28 has a bolt hole on a top surface thereof. The shaft portion of the bolt 29 serving to fix the overhanging member 71 to the spacer 28 is screwed into the bolt hole. The head portion of the bolt 29 presses the overhanging member 71 from above. A groove 71*b* extending in a diametrical direction of the chuck 20 is formed on the top surface of the overhanging member 71. The groove 71*b* accommodates the head portion of the bolt 29 therein, and the head portion of the bolt 29 presses a bottom of the groove 71*b* from above. The head of the bolt 29 and the bottom of the groove 71*b* are horizontal.

While the top surface of the overhanging member 71 is inclined, a bottom surface of the overhanging member 71 is horizontal. If the bottom surface of the overhanging member 71 is horizontal, the overhanging member 71 can be stably disposed on the plurality of spacers 28. The number of the spacers 28 is desirably three or more.

The chuck cover 70 includes an outer cylindrical member 77 extending downwards from a periphery of the overhanging member 71. Although the outer cylindrical member 77 is extended straightly downwards in FIG. 5, it may be extended obliquely downwards. The outer cylindrical member 77 is extended below an upper end of an inner cylindrical member 67 of the table cover 60 to be described later to surround the inner cylindrical member 67. The inner cylindrical member 67 and the outer cylindrical member 77 form a labyrinth that suppresses the introduction of the grinding liquid.

A boundary between the overhanging member 71 and the outer cylindrical member 77 has, for example, a chamfered shape and a curved shape. If the boundary has an angled shape, a surface tension of liquid droplets may inhibit the liquid droplets from crossing the boundary. As a result, a ring-shaped liquid puddle may be easily formed. If the boundary between the overhanging member 71 and the outer cylindrical member 77 has the curved shape, on the other hand, the liquid droplets may easily cross the boundary, and the grinding liquid may be easily drained. Therefore, the grinding residues mixed with the grinding liquid can be suppressed from being deposited in a ring shape.

As illustrated in FIG. 5, the grinding apparatus 1 has the table cover 60 configured to be rotated together with the table 10. The table cover 60 has the inclined member 61 which is inclined downwards as it goes away from the rotation center line R1 of the table 10.

The inclined member 61 is disposed below the top surface of the holding table 21 of the chuck 20 and above the table 10. Unlike a horizontal flat member, the inclined member 61 can drain the grinding liquid obliquely downwards by gravity. Therefore, it is possible to suppress the deposition of the grinding residues mixed with the grinding liquid.

The inclined member 61 has a conical shape with a constant height in the circumferential direction of the table 10, for example. When the inclined member 61 has the conical shape, the grinding liquid can be radially drained as indicated by the arrows in FIG. 3, so that the deposition of the grinding residues around the chuck 20 can be suppressed.

In addition, the inclined member 61 may have a pyramidal shape. When the inclined member 61 has this pyramidal shape, however, a groove G indicated by a dashed double-dotted line in FIG. 3 is formed. The chuck 20 is located at the bottom of the groove G, and the grinding liquid tends to be easily collected near the chuck 20, so the grinding residue mixed with the grinding liquid may be easily deposited.

As shown in FIG. 5, the inclined member 61 is provided with, between a top portion and a distal end thereof, the opening 61*a* into which the rotary table 25 is inserted. The opening 61*a* is formed for each rotary table 25, and is formed in multiple numbers at a distance therebetween around the rotation center line R1 of the table 10. The plurality of openings 61*a* are formed at, for example, an equal distance therebetween.

The table cover 60 includes the inner cylindrical member 67 that extends upwards from an opening edge of the opening 61*a* of the inclined member 61. Although the inner cylindrical member 67 is extended straightly upwards in FIG. 5, it may be extended obliquely upwards. An upper edge of the inner cylindrical member 67 is horizontal over the entire circumferential direction thereof. The inner cylindrical member 67 suppresses the grinding liquid from entering the opening 61*a*.

Figure 6A:
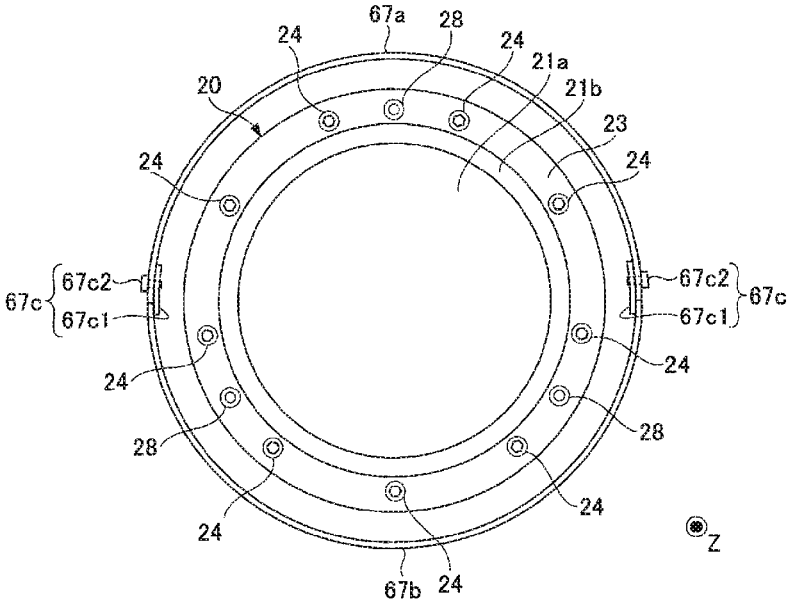
FIG. 6A is a top view illustrating an example of an inner cylindrical member shown in FIG. 5.

As shown in FIG. 6A, the inner cylindrical member 67 includes a first arc-shaped cylindrical member 67*a*, a second arc-shaped cylindrical member 67*b*, and a connecting member 67*c*. The first arc-shaped cylindrical member 67*a* is fixed to the inclined member 61. The second arc-shaped cylindrical member 67*b* is detachably connected to the first arc-shaped cylindrical member 67*a*. The connecting member 67*c* connects the first arc-shaped cylindrical member 67*a* and the second arc-shaped cylindrical member 67*b* annularly.

The connecting member 67*c* includes, by way of example, a connecting plate 67*c*1 and a bolt 67*c*2. The connecting plate 67*c*1 is fixed to, for example, an inner peripheral surface of the second arc-shaped cylindrical member 67*b* and is extended up to an inner peripheral surface of the first arc-shaped cylindrical member 67*a*. A shaft portion of the bolt 67*c*2 is screwed into a bolt hole of the connecting plate 67*c*1 through a through hole of the first arc-shaped cylindrical member 67*a*. A head portion of the bolt 67*c*2 presses the first arc-shaped cylindrical member 67*a* from a radially outside thereof.

In addition, the structure of the connecting member 67*c* is not particularly limited. For example, the connecting plate 67*c*1 may be fixed to the inner peripheral surface of the first arc-shaped cylindrical member 67*a*, and may be extended up to the inner peripheral surface of the second arc-shaped cylindrical member 67*b*. In this case, the shaft portion of the bolt 67*c*2 is screwed into the bolt hole of the connecting plate 67*c*1 through a through hole of the second arc-shaped cylindrical member 67*b*. The head portion of the bolt 67*c*2 presses the second arc-shaped cylindrical member 67*b* from a radially outside thereof.

Figure 6B:
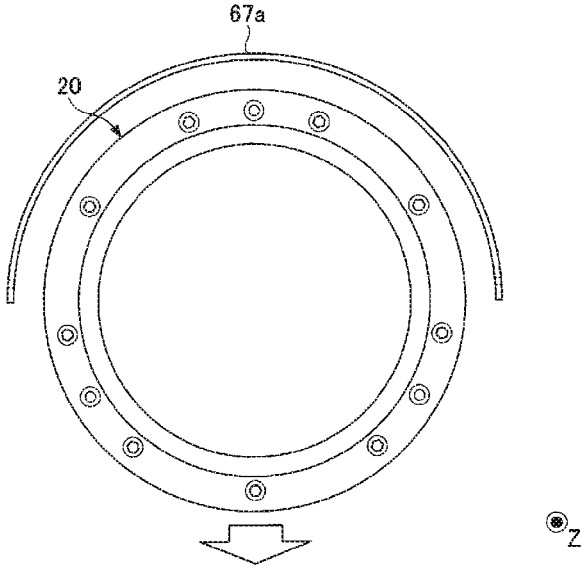
FIG. 6B is a top view illustrating an example state in which a part of the inner cylindrical member shown in FIG. 6A is separated.

Either way, by loosening or tightening the bolt 67*c*2, the second arc-shaped cylindrical member 67*b* can be removed or installed. As can be clearly seen from FIG. 6B, by separating the second arc-shaped cylindrical member 67*b*, the chuck 20 can be easily replaced.

As depicted in FIG. 5, the second arc-shaped cylindrical member 67*b* is disposed at an outer side than the first arc-shaped cylindrical member 67*a* in the diametrical direction of the table 10. At least a part of a lower edge of the second arc-shaped cylindrical member 67*b* is disposed below the top surface of the rotary table 25.

Figure 7:
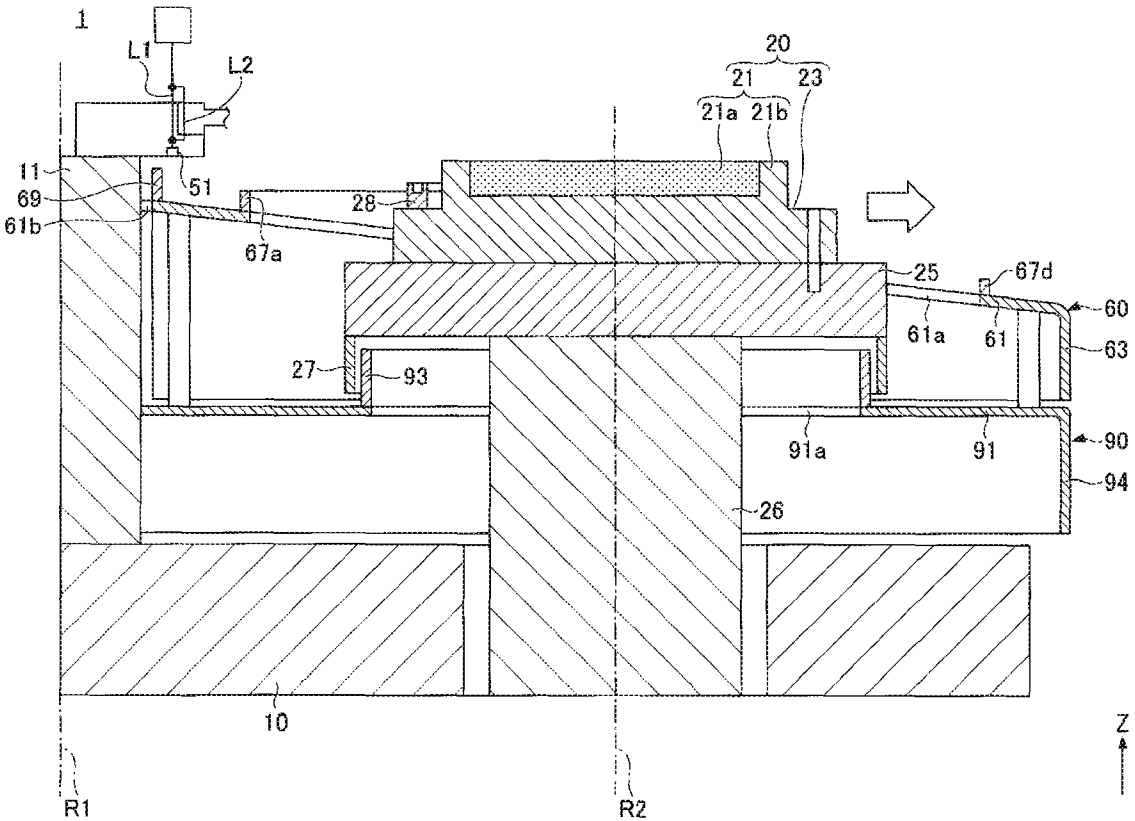
FIG. 7 is a cross sectional view illustrating an example state in which a part of the inner cylindrical member shown in FIG. 5 is separated.

As a result, if the second arc-shaped cylindrical member 67*b* is removed, the chuck 20 mounted on the top surface of the rotary table 25 can be pulled out sideways, as shown in FIG. 7. This is advantageous when the chuck 20 cannot be removed upwards as the chuck 20 and the rotary table 25 have strong adhesion.

As shown in FIG. 5, the inner cylindrical member 67 may further include a third arc-shaped cylindrical member 67*d* on which the second arc-shaped cylindrical member 67*b* is mounted. The third arc-shaped cylindrical member 67*d* may be fixed to the inclined member 61, and may be integrated as one body with the first arc-shaped cylindrical member 67*a*.

The inner cylindrical member 67 may further include an alignment member 67*e* configured to align the second arc-shaped cylindrical member 67*b* and the third arc-shaped cylindrical member 67*d*. The alignment member 67*e* is fixed to, for example, the inner peripheral surface of the second arc-shaped cylindrical member 67*b*, and is inserted into the third arc-shaped cylindrical member 67*d*. As the alignment member 67*e* comes into contact with an inner peripheral surface of the third arc-shaped cylindrical member 67*d*, the second arc-shaped cylindrical member 67*b* and the third arc-shaped cylindrical member 67*d* are aligned.

The table cover 60 has a cylindrical member 63 extending downwards from the lower edge of the inclined member 61. Although the cylindrical member 63 is extended straightly downwards in FIG. 5, it may be extended obliquely downwards. The cylindrical member 63 allows the grinding liquid to fall outside the table 10. The outer diameter of the cylindrical member 63 is larger than the diameter of the table 10.

A boundary between the inclined member 61 and the cylindrical member 63 has, for example, a chamfered shape and a curved shape. As compared to a case where the boundary is of an angled shape, liquid droplets may easily cross the boundary, and the grinding liquid can be easily drained. Therefore, it is possible to suppress the grinding residues mixed with the grinding liquid to be deposited in a ring shape.

The inclined member 61 is provided with, at the top portion thereof, an opening 61*b* through which a fixed shaft 11 passes. The table cover 60 has a central cylindrical member 69 extending upwards from the opening edge of the opening 61*b* of the inclined member 61. Although the central cylindrical member 69 is extended straightly upwards in FIG. 5, it may be extended obliquely upwards. The central cylindrical member 69 suppresses the grinding liquid from entering the opening 61*b*.

The table cover 60 is divided into a plurality of division covers in the circumferential direction of the table 10. The number of the division covers is the same as the number of the chucks 20. The rotary partition walls 15 are disposed between the division covers neighboring in the circumferential direction.

The plurality of division covers are individually provided to the table 10 in the removable manner. For maintenance, each division cover can be separated individually. Since it is not necessary to remove the whole table cover 60 at once, the workability can be improved.

The grinding apparatus 1 includes a base cover 90. The base cover 90 has a horizontal disk member 91. The disk member 91 is disposed above the table 10 under the table cover 60 to be concentric with the table 10. The diameter of the disk member 91 is larger than the diameter of the table 10.

The disk member 91 is provided with, around the rotation center line R1 of the table 10, an opening 91*a* through which a rotation shaft 26 of the chuck 20 passes. The opening 91*a* is plural in number, and these openings 91*a* are arranged at an equal distance therebetween around the rotation center line R1 of the table 10.

The base cover 90 includes an inner cylindrical member 93 extending upwards from the opening edge of the opening 91*a*. Although the inner cylindrical member 93 is extended straightly upwards in FIG. 5, it may be extended diagonally upwards. The rotation shaft 26 is inserted through the inner cylindrical member 93.

The rotation shaft 26 is extended vertically downwards from the rotation center of the rotary table 25. An outer cylindrical member 27 extending downwards is provided at the periphery of the rotary table 25. Although the outer cylindrical member 27 is extended straightly downwards in FIG. 5, it may be extended diagonally downwards.

The outer cylindrical member 27 is extended below the upper end of the inner cylindrical member 93 of the base cover 90 to surround the inner cylindrical member 93. A labyrinth that suppresses the introduction of the grinding liquid can be formed by the inner cylindrical member 93 and the outer cylindrical member 27.

The openings 91*a* are arranged at the equal distance therebetween around the rotational center line R1 of the table 10 as mentioned above. The rotary partition walls 15 are disposed between the openings 91*a* neighboring in the circumferential direction of the table 10. The rotary partition walls 15 are provided on the disk member 91.

The base cover 90 has a cylindrical member 94 extending downwards from the periphery of the disk member 91. Although the cylindrical member 94 is extended straightly downwards in FIG. 5, it may be extended diagonally downward.

A boundary between the disk member 91 and the cylindrical member 94 has, for example, a chamfered shape and a curved shape. As compared to a case where the boundary has an angled shape, it is easy for liquid droplets to cross the boundary, so that the grinding liquid can be easily drained. Thus, it is possible to suppress the grinding residues mixed with the grinding liquid to be deposited in a ring shape.

As illustrated in FIG. 5, the grinding apparatus 1 is equipped with a nozzle 51 configured to supply a cleaning liquid to the inclined member 61 from between the top portion of the inclined member 61 of the table cover 60 and the chuck 20. The nozzle 51 supplies the cleaning liquid to the inclined member 61 from above. The nozzle 51 may be provided at the central cylindrical member 69. The cleaning liquid is, for example, pure water. After the cleaning liquid is supplied to the inclined member 61, it flows obliquely downwards and fall down due to gravity. With the cleaning liquid, a wide range of the inclined member 61 can be cleaned, so that the deposition of the grinding residues around the chuck 20 can be suppressed. The nozzle 51 may supply the cleaning liquid to the inclined member 61 from a position allowing the cleaning liquid to reach the top portion of the inclined member 61. The entire inclined member 61 ranging from the top portion to the distal end thereof can be cleaned.

The nozzle 51 discharges the cleaning liquid during the grinding of the substrate W, for example, to thereby wash off the grinding liquid and the grinding residues adhering to the inclined member 61. The nozzle 51 is provided not only in the first grinding chamber B1 but also in the second grinding chamber B2 and the third grinding chamber B3. The nozzle 51 may be provided in the carry-in/out chamber B0 as well. The nozzle 51 may discharge the cleaning liquid when the grinding of the substrate W is not performed.

The inclined member 61 of the table cover 60 is provided with, at the top portion thereof, the opening 61*b* through which the fixed shaft 11 passes. The central cylindrical member 69 extends upwards from the opening edge of the opening 61*b*, and the nozzle 51 is disposed at the radially outside of the central cylindrical member 69. It is possible to suppress the cleaning liquid from reaching the inside of the central cylindrical member 69.

The grinding apparatus 1 is equipped with a measuring device 95 configured to measure the thickness of the substrate W. The measuring device 95 includes the nozzle 51. Inside the measuring device 95, flow paths L1 and L2 for a cleaning liquid are formed. The flow path L2 passes through a base end of at least one of a first arm 95*c* and a second arm 95*d* to be described later. The cleaning liquid passes through the flow path L2, absorbs heat from a first height sensor 95*a* via the first arm 95*c*, and is discharged from the nozzle 51. Alternatively, the cleaning liquid passes through the flow path L2, absorbs heat from a second height sensor 95*b* via the second arm 95*d*, and is discharged from the nozzle 51. At least one of the first height sensor 95*a* and the second height sensor 95*b* can be cooled by the cleaning liquid. In addition, the flow path L2 for cooling may be formed separately from the flow path L1 for nozzle.

The measuring device 95 includes, by way of example, the first height sensor 95*a* configured to measure the height of the substrate W and the second height sensor 95*b* configured to measure the height of the chuck 20. The thickness of the substrate W can be measured from a difference between the height of the substrate W and the height of the chuck 20. Although the measuring device 95 is shown to be of a contact type in FIG. 5, it may be of a non-contact type.

The measuring device 95 includes the first arm 95*c* holding the first height sensor 95*a*, the second arm 95*d* holding the second height sensor 95*b*, and a bracket 95*e* holding the first arm 95*c* and the second arm 95*d*. The nozzle 51 is provided in a bottom surface of the bracket 95*e*.

The bracket 95*e* of the measuring device 95 is fastened on a top surface of the fixed shaft 11 and protrudes radially outwards from the fixed shaft 11. The nozzle 51 is provided at a portion of the bottom surface of the bracket 95*e* protruding radially outwards from the fixed shaft 11 to supply the cleaning liquid to the inclined member 61.

Figure 8:
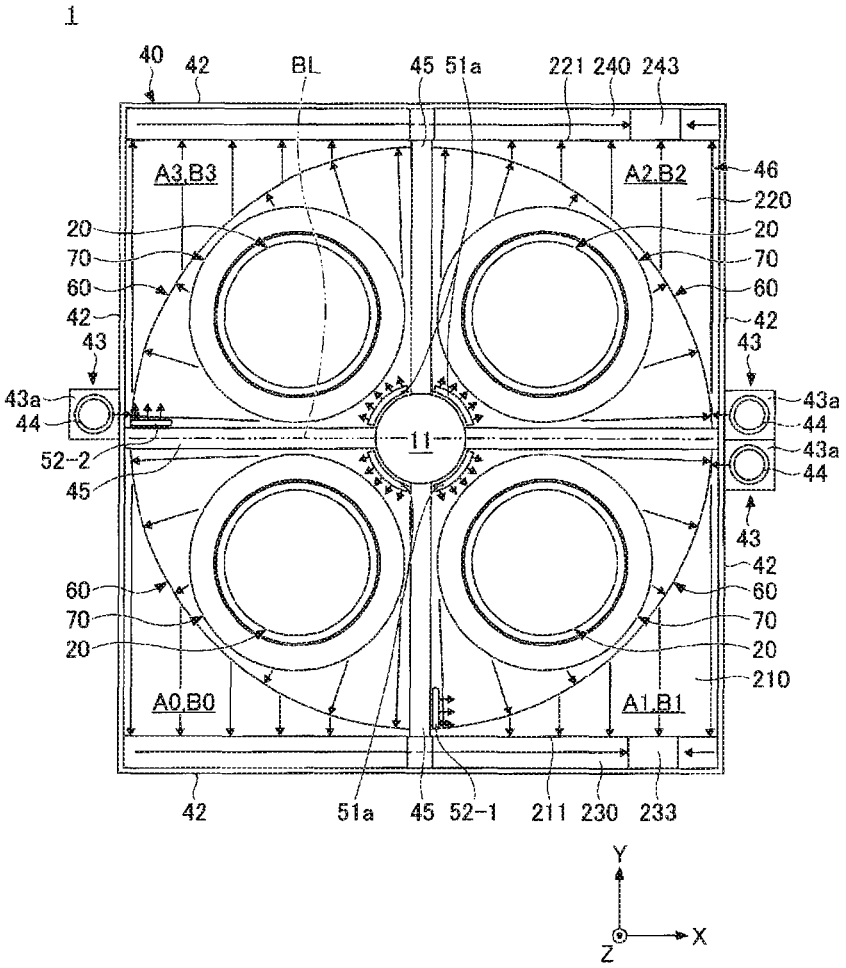
FIG. 8 is a plan view illustrating an example flow of a cleaning liquid.

As shown in FIG. 8, supply openings 51*a* of the nozzles 51 are provided at a distance therebetween in the circumferential direction of the table cover 60 (rotation direction of the table cover 60). A plurality of supply openings 51*a* may be provided in one room (for example, first grinding chamber B1). Due to the presence of the plurality of supply openings 51*a*, the wide range of the inclined member 61 of the table cover 60 in the circumferential direction can be cleaned at one time. In addition, the supply opening 51*a* of the nozzle 51 is an arc-shaped slit formed along the circumferential direction of the table cover 60. With this configuration, the cleaning liquid can be supplied at a position close to the top portion of the inclined member 61 of the table cover 60. Further, the supply opening 51*a* of the nozzle 51 may be straight line-shaped slit or a circular hole.

However, at the distal end of the inclined member 61, the surface tension of the liquid droplet inhibits the liquid droplets from flowing over the distal end. As a result, a ring-shaped liquid is likely to be formed, resulting in adhesion of a ring-shaped contaminant.

To solve this problem, the grinding apparatus 1 is equipped with nozzles 52-1 and 52-2 configured to supply a cleaning liquid to the distal end of the inclined member 61 of the table cover 60 from above. The cleaning liquid is, for example, pure water. The cleaning liquid washes away the grinding liquid contaminated with the grinding residues, thus suppressing the adhesion of the ring-shaped contaminant.

In the first grinding chamber B1, the nozzle 52-1 is located in the vicinity of a boundary between the first grinding chamber B1 and the carry-in/out chamber B0. The vicinity of the boundary means a range within 50 mm from the fixed partition wall 45 which is the boundary. At least a part of a discharge opening of the nozzle 52-1 needs to be located within the range.

Meanwhile, in the third grinding chamber B3, the nozzle 52-2 is located in the vicinity of a boundary between the third grinding chamber B3 and the carry-in/out chamber B0. The vicinity of the boundary means a range within 50 mm from the fixed partition wall 45 which is the boundary. At least a part of a discharge opening of the nozzle 52-2 needs to be located within the range.

While the table 10 is being rotated in the clockwise direction when viewed from above, the controller 16 is configured to supply the cleaning liquid to the distal end of the inclined member 61 of the table cover 60 from the nozzle 52-1 disposed in the first grinding chamber B1. The distal end of the inclined member 61 can be cleaned just before it is moved from the first grinding chamber B1 to the carry-in/out chamber B0, so that it is possible to suppress the contaminant from being carried into the carry-in/out chamber B0.

Meanwhile, while the table 10 is being rotated in the counterclockwise direction when viewed from above, the controller 16 supplies the cleaning liquid to the distal end of the inclined member 61 of the table cover 60 from the nozzle 52-2 disposed in the third grinding chamber B3. The distal end of the inclined member 61 can be cleaned just before it is moved from the third grinding chamber B3 to the carry-in/out chamber B0, so that it is possible to suppress the contaminant from being carried into the carry-in/out chamber B0.

As shown in FIG. 8, the grinding apparatus 1 is equipped with exhaust boxes 43 located outside the housing 40 and configured to exhaust a gas from the housing 40. Each exhaust box 43 is connected via a pipe 44 to a non-illustrated suction source. The suction source is, for example, a vacuum pump or an ejector. The suction source may be a part of factory equipment. The pipe 44 is provided at a ceiling 43*a* of the exhaust box 43, for example. The exhaust box 43 exhausts the gas from the inside of the housing 40 by a suction force of the suction source to turn the inside of the housing 40 into a negative pressure as compared to the outside of the housing 40, thus suppressing a leak of the grinding residue and the grinding liquid.

The three exhaust boxes 43 individually exhaust the gas from the three grinding chambers B1 to B3, turning the three grinding chambers B1 to B3 into a negative pressure as compared to the outside of the housing 40. The atmospheric pressure of the carry-in/out chamber B0 is higher than that of the grinding chambers B1 to B3. This pressure difference restricts the scattering of the grinding residue and the grinding liquid from the grinding chambers B1 to B3 into the carry-in/out chamber B0.

In addition, the number of the exhaust boxes 43 and the number of the grinding chambers are not limited to three. Further, the number of the exhaust boxes 43 and the number of the pipes 44 may not be the same number. By way of example, one pipe 44 may be connected across two adjacent exhaust boxes 43.

When exhausting the gas from the inside of the housing 40, the exhaust box 43 also drains droplets of the grinding liquid from the inside of the housing 40. The droplets of the grinding liquid are mixed with the grinding residue generated during the grinding.

Figure 9A:
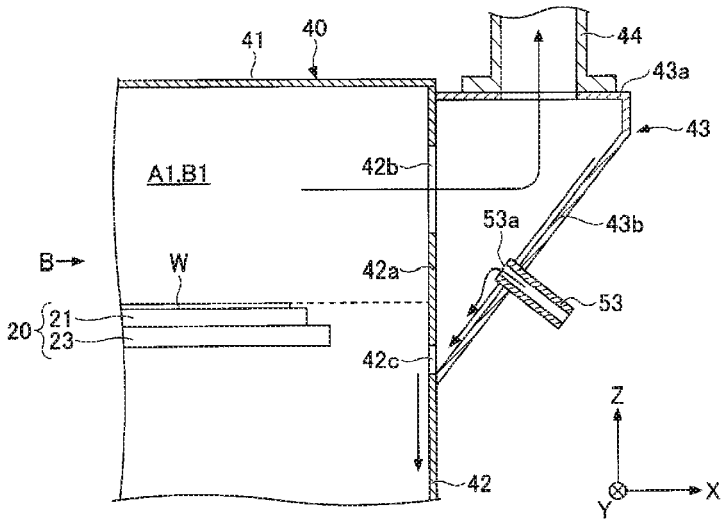
FIG. 9A is a cross sectional view illustrating an example of an exhaust box, taken along a line A-A of FIG. 9B.
Figure 9B:
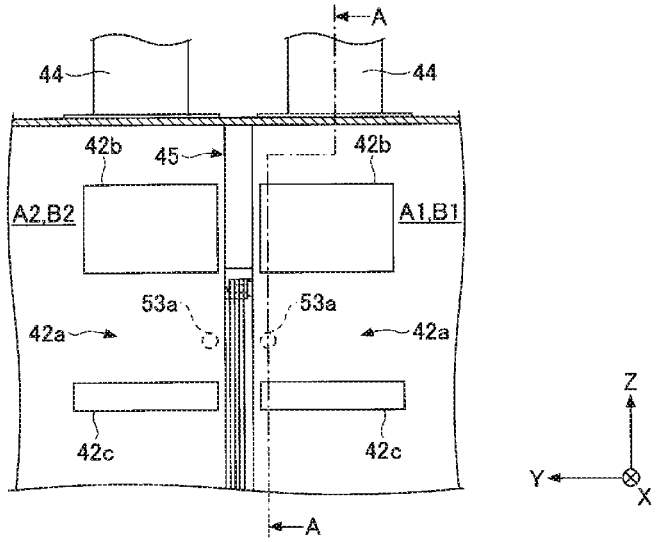
FIG. 9B is a diagram illustrating an example of a side panel and a fixed partition wall seen from the direction of an arrow B of FIG. 9A.

In view of this, as shown in FIG. 9A and FIG. 9B, the side panel 42 of the housing 40 includes a liquid receiving member 42*a*, an exhaust opening 42*b*, and a return opening 42*c* to suppress the grinding liquid contaminated with the grinding residue from being drained to the outside of the grinding apparatus 1 together with the gas.

The liquid receiving member 42*a* is located on a level with the substrate W held by the chuck 20 and receives the grinding liquid horizontally scattered from the top surface of the substrate W. The liquid receiving member 42*a* restricts a large amount of the grinding liquid from entering the exhaust box 43.

The exhaust opening 42*b* is located above the liquid receiving member 42*a*, for example, directly above the liquid receiving member 42*a*. Since the grinding liquid falls down due to gravity after coming into contact with the liquid receiving member 42*a*, it hardly enters the exhaust opening 42*b*.

The exhaust opening 42*b* communicates with the inside of the exhaust box 43. The exhaust box 43 exhausts the gas from the inside of the housing 40 via the exhaust opening 42*b*. The gas contains the droplets of the grinding liquid mixed therein.

The exhaust box 43 separates therein the droplets of the grinding liquid from the gas. The droplets of the grinding liquid have a higher density than the gas and are separated from the gas by gravity or the like. The separated grinding liquid falls down.

The return opening 42*c* is located under the liquid receiving member 42*a*, for example, directly under the liquid receiving member 42*a*. The return opening 42*c* returns the grinding liquid separated from the gas within the exhaust box 43 to the inside of the housing 40. Thus, the grinding liquid contaminated with the grinding residue can be suppressed from being drained to the outside of the grinding apparatus 1 together with the gas.

The exhaust box 43 has an inclined surface 43*b* that guides the grinding liquid separated from the gas within the exhaust box 43 obliquely downwards toward the return opening 42*c* of the side panel 42. The inclined surface 43*b* approaches the side panel 42 as it goes downwards. The grinding liquid flows down along the inclined surface 43*b*. This flow may suppress the contaminant from adhering to the inclined surface 43*b*.

The inclined surface 43*b* of the exhaust box 43 becomes closers to the side panel 42 as it goes downwards from, for example, a position higher than the exhaust port 42*b* of the side panel 42 to a position on a level with the return opening 42*c* of the side panel 42. After passing through the exhaust opening 42*b* of the side panel 42 along with the gas, the droplets of the grinding liquid adhere to the inclined surface 43*b* of the exhaust box 43 and flow down along the inclined surface 43*b*.

The grinding apparatus 1 may be equipped with a nozzle 53 configured to supply the cleaning liquid into the housing 40 through the inside of the exhaust box 43. The cleaning liquid is, for example, pure water such as DIW. After being supplied into the exhaust box 43, the cleaning liquid is then supplied into the housing 40 through the return opening 42*c* of the side panel 42. Unlike the grinding liquid, the cleaning liquid does not contain a contaminant such as the grinding residue. Thus, the inside of the exhaust box 43 and the inside of the housing 40 can be cleaned.

The nozzle 53 is provided at the inclined surface 43*b* of the exhaust box 43, for example. The cleaning liquid flows down along the inclined surface 43*b*. This flow may suppress a contaminant from adhering to the inclined surface 43*b*. The nozzle 53 may or may not protrude upwards from the inclined surface 43*b*.

Here, as illustrated in FIG. 8, when viewed from above, at the boundary between adjacent chambers (for example, between B1 and B2 or between B0 and B3), a gap between the side panel 42 and the circular table cover 60 or the like is the narrowest. The grinding residue tends to be easily accumulated in this narrow gap.

Further, even when the table cover 60 is not present, a gap between the table 10 and the side panel 42 is the narrowest at the boundary of the adjacent chambers, when viewed from above. This narrow gap may be easily clogged with the grinding residue accumulated therein.

In view of the foregoing, in the present exemplary embodiment, the return opening 42*c* of the side panel 42 is disposed near the boundary between the adjacent chambers (for example, between B1 and B2 or between B0 and B3) and near the fixed partition wall 45. Here, the "near the fixed partition wall 45" refers to a range within 50 mm from the fixed partition wall 45, for example. At least a part of the return opening 42*c* needs to be located within this range.

The return opening 42*c* of the side panel 42 is disposed near the boundary between the adjacent chambers (for example, between B1 and B2 or between B0 and B3) to supply the cleaning liquid into the gap between the side panel 42 and the table cover 60 or the like, thus forming a liquid flow. This liquid flow suppresses the grinding residue from being accumulated in the corresponding gap to clog it.

As shown in FIG. 9B, when viewed from the front of the side panel 42, a discharge opening 53*a* of the nozzle 53 may be disposed as close to the boundary of the adjacent chambers as possible, that is, as close to the fixed partition wall 45 as possible.

For example, when viewed from the front of the side panel 42, the distance between the fixed partition wall 45 and the discharge opening 53*a* of the nozzle 53 and the distance between the fixed partition wall 45 and the return opening 42*c* may be same. The cleaning liquid can be supplied into the housing 40 from a leading end of the return opening 42*c* closest to the fixed partition wall 45.

Furthermore, although not shown, the liquid receiving member 42*a* of the side panel 42 may be provided with a nozzle configured to supply the cleaning liquid into the housing 40. This nozzle is provided at an upper portion of the liquid receiving member 42*a*, for example. After being discharged from the nozzle, the cleaning liquid flows down along the liquid receiving member 42*a* while washing away the grinding residue adhering to the liquid receiving member 42*a*.

As illustrated in FIG. 8 and FIG. 10A to FIG. 10C, the housing 40 includes a pan 46 located below the plurality of chucks 20 and configured to receive the grinding liquid and the grinding residue that are falling down. The pan 46 receives the cleaning liquid as well. Hereinafter, the grinding liquid and the cleaning liquid will be referred to as a liquid together. In addition, the liquid contaminated with the grinding residue will be referred to as contaminated liquid. The pan 46 has two inclined surfaces 210 and 220 on a top surface thereof.

Figure 10A:
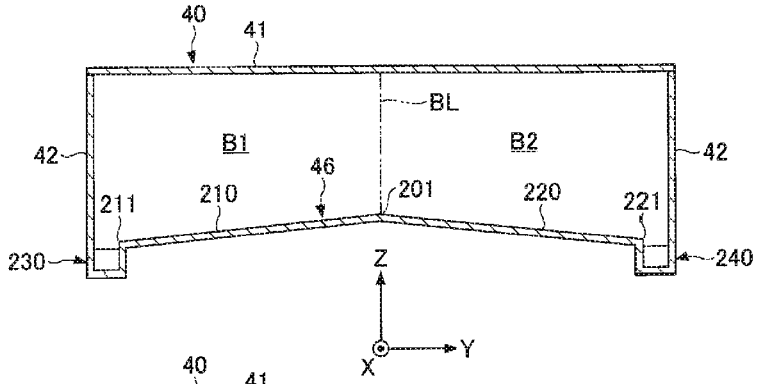
FIG. 10A is a cross sectional view illustrating an example of a pan seen from the X-axis direction.

As shown in FIG. 10A, the two inclined surfaces 210 and 220 are combined in a mountain shape, and they slope downwards as they go farther from a boundary line BL between the two neighboring chambers B0 and B1 and the remaining two chambers B2 and B3. The two inclined surfaces 210 and 220 allow the contaminated liquid to be flown on both sides with the boundary line BL therebetween and dropped down.

According to the present exemplary embodiment, the two inclined surfaces 210 and 220 are combined in the mountain shape. Thus, as compared to a case where only one inclined surface is provided, a horizontal distance of the inclined surface is short and a gradient of the inclination is steep if the height difference of the inclined surface is the same. Therefore, the contaminated liquid may easily fall down. Therefore, the flow of the grinding residue and the grinding liquid on the pan 46 can be improved.

As depicted in FIG. 10A, the pan 46 has two gutter 230 and 240 along lower edges 211 and 221 of the two inclined surfaces 210 and 220, respectively. The contaminated liquid flows down along the two inclined surfaces 210 and 220 to reach the two gutters 230 and 240.

Figure 10B:
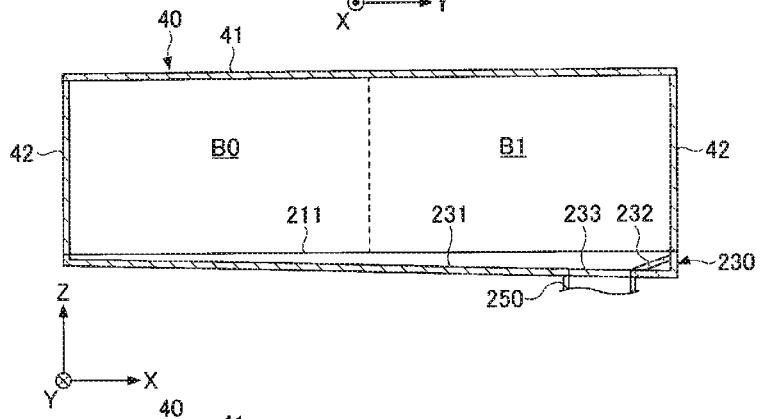
FIG. 10B is a cross sectional view illustrating an example of the pan seen from the negative Y-axis direction.
Figure 10C:
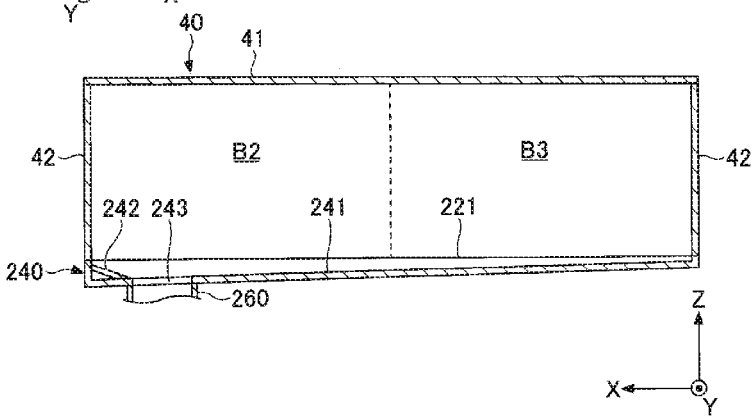
FIG. 10C is a cross sectional view illustrating an example of the pan seen from the positive Y-axis direction.

As shown in FIG. 10B and FIG. 10C, each gutter 230 (240) has, at a bottom thereof, a guide surface 231 (241) that slopes downwards from one end of the lower edge 211 (221) to the other end thereof. By the guide surfaces 231 and 241, the contaminated liquid can be collected.

As illustrated in FIG. 10B, the gutter 230 has, at the bottom thereof, the guide surface 231 inclined downwards from the carry-in/out chamber B0 toward the first grinding chamber B1. By the inclination of the guide surface 231, it is possible to suppress a first grinding residue included in the contaminated liquid from reaching the carry-in/out chamber B0 from the first grinding chamber B1, so that the carry-in/out chamber B0 can be kept clean.

Moreover, as shown in FIG. 10B, the gutter 230 may have, at the bottom thereof, a guide surface 232 that is inclined in a direction opposite to that of the guide surface 231. The guide surface 232 is shorter than the guide surface 231 and is disposed at a corner of the first grinding chamber B1 opposite to the carry-in/out chamber B0.

As shown in FIG. 10C, the gutter 240 has, at the bottom thereof, a guide surface 241 that is inclined downwards from the third grinding chamber B3 toward the second grinding chamber B2. By the inclination of the guide surface 241, it is possible to suppress a second grinding residue having a large particle size from reaching the third grinding chamber B3 from the second grinding chamber B2, so that roughening of a ground surface after the third grinding can be reduced.

As shown in FIG. 10C, the gutter 240 may have, at the bottom thereof, a guide surface 242 that is inclined in a direction opposite to that of the guide surface 241. The guide surface 242 is shorter than the guide surface 241, and is disposed at a corner of the second grinding chamber B2 opposite to third grinding chamber B3.

Each gutter 230 (240) includes an outlet 233 (243) for draining the contaminated liquid at the lowermost portion of the bottom thereof. A pipe 250 (260) extending downwards from the outlet 233 (243) is connected to the outlet 233 (243).

The contaminated liquid flows down along the guide surfaces 231 and 241 to be drained from the outlets 233 and 243 into the pipes 250 and 260, respectively. Since the outlets 233 and 243 are located at the lowermost portion, the collected contaminated liquid can be efficiently drained.

Figure 11:
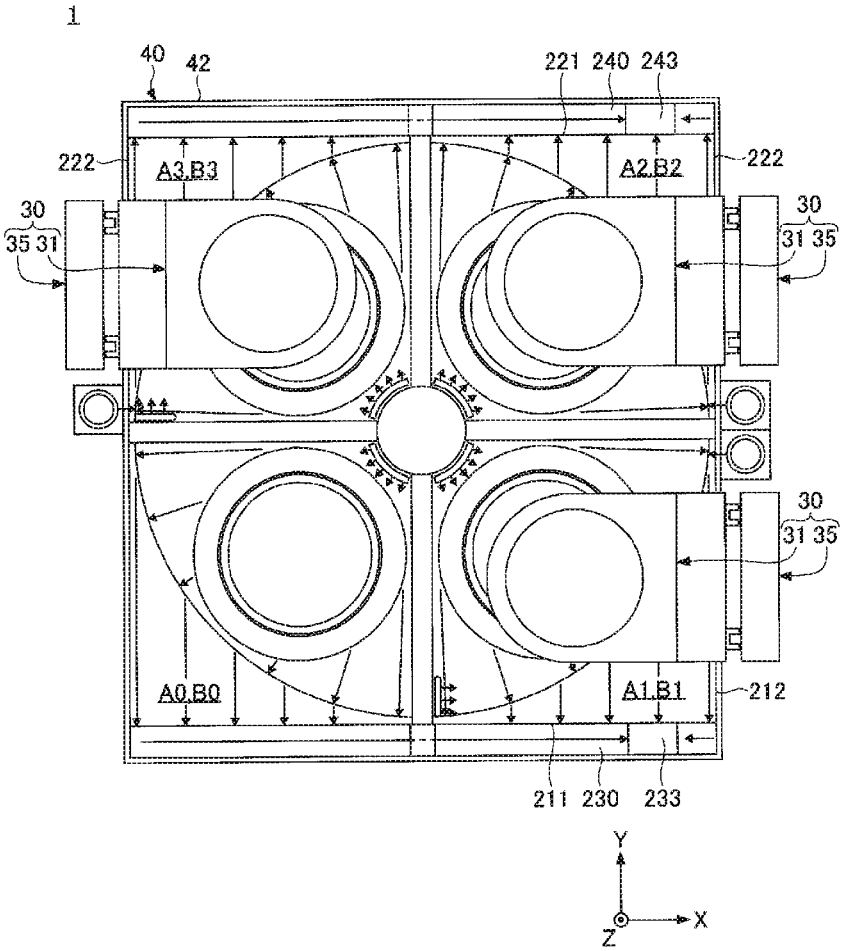
FIG. 11 is a plan view illustrating an example of the housing and the tool driving unit shown in FIG. 8.

As shown in FIG. 11, the tool driving unit 30 includes the moving unit 31 to which the grinding tool D is mounted, and the elevating unit 35 configured to move the moving unit 31 up and down. The elevating unit 35 faces a mountain-shaped slope edge 212 (222) of the inclined surface 210 (220) instead of the lower edge 211 (221) of the inclined surface 210 (220). Since the elevating unit 35 does not face the gutter 230 (240), maintenance of the gutter 230 (240) may be easily performed.

As stated above, the grinding liquid and the cleaning liquid are supplied into the housing 40. The grinding residue is flown into the outlet 233 (243) together with these liquids. As a result, the outlet 233 (243) may sometimes be blocked.

Figure 12:
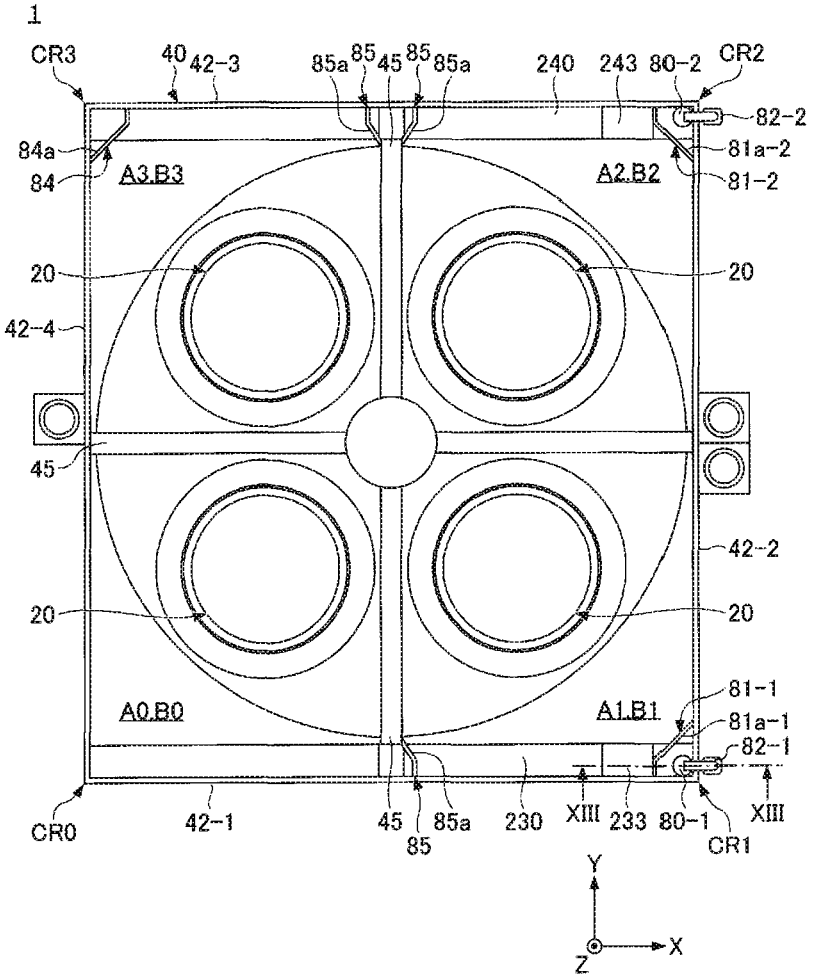
FIG. 12 is a plan view illustrating an example layout of a liquid level sensor.

To solve this problem, as shown in FIG. 12, the grinding apparatus 1 is equipped with a first liquid level sensor 80-1 (80-2) located within the housing 40. The first liquid level sensor 80-1 (80-2) is configured to detect a liquid level of the liquid collected within the housing 40. When the detected liquid level exceeds a preset height, the controller 16 makes a determination that the outlet 233 (243) is blocked.

Further, the grinding apparatus 1 also includes a sensor cover 81-1 (81-2) positioned between the chuck 20 and the first liquid level sensor 80-1 (80-2). The sensor cover 81-1 (81-2) blocks the contaminated liquid flowing from the substrate W held by the chuck 20 toward the first liquid level sensor 80-1 (80-2) on the way. Therefore, the contaminant can be suppressed from adhering to the first liquid level sensor 80-1 (80-2), so that a malfunction of the first liquid level sensor 80-1 (80-2) can be suppressed. In addition, an impact applied to the first liquid level sensor 80-1 (80-2) can be reduced, so that breakdown of the first liquid level sensor 80-1 (80-2) can be suppressed.

The housing 40 includes four side panels 42-1, 42-2, 42-3, and 42-4 positioned on the sides of the chucks 20. These side panels 42 are assembled into a rectangle to form four corners CR0 to CR3. CR0 is the corner of the carry-in/out chamber B0; CR1, the corner of the first grinding chamber B1; CR2, the corner of the second grinding chamber B2; and CR3, the corner of the third grinding chamber B3.

The first liquid level sensor 80-1 is located at the corner CR1, and the other first liquid level sensor 80-2 is located at the other corner CR2. By disposing the first liquid level sensors 80-1 and 80-2 at the corners CR1 and CR2, interference with other members can be suppressed.

When viewed from above, the sensor cover 81-1 has a slanting plate 81*a*-1 inclined with respect to each of the two side panels 42-1 and 42-2 forming the corner CR1. The first liquid level sensor 80-1 is located in a space surrounded by the two side panels 42-1 and 42-2 and the slanting plate 81*a*-1. By hiding the corner CR1 with the slanting plate 81*a*-1, it is possible to suppress the contaminant from being gathered at the corner CR1.

Further, when viewed from above, the sensor cover 81-2 has a slanting plate 81*a*-2 inclined with respect to each of the two side panels 42-2 and 42-3 forming the corner CR2. The first liquid level sensor 80-2 is located in a space surrounded by the two side panels 42-2 and 42-3 and the slanting plate 81*a*-2. By hiding the corner CR2 with the slanting plate 81*a*-2, it is possible to suppress the contaminant from being gathered at the corner CR2.

When viewed from above, the first liquid level sensor 80-1 overlaps the gutter 230, and the other first liquid level sensor 80-2 overlaps the other gutter 240. The first liquid level sensor 80-1 (80-2) may be located inside the gutter 230 (240) or may be located above the gutter 230 (240). Either way, the liquid level can be detected at the position of the gutter 230 (240) where the liquid is collected.

When viewed from above, the first liquid level sensor 80-1 (80-2) is located near the outlet 233 (243). By disposing the first liquid level sensor 80-1 (80-2) near the outlet 233 (243), clogging of the outlet 233 (243) can be reliably detected. "Near the outlet 233 (243)" is, for example, within a range of 50 mm from the outlet 233 (243).

The grinding apparatus 1 is equipped with, apart from the first liquid level sensors 80-1 and 80-2, second liquid level sensors 82-1 and 82-2 configured to detect the liquid level of the liquid collected within the housing 40. The first liquid level sensor 80-1 and the second liquid level sensor 82-1 are disposed at the same corner CR1 and detect the same liquid level. Further, the first liquid level sensor 80-2 and the second liquid level sensor 82-2 are disposed at the same corner CR2 and detect the same liquid level. With this configuration, the same liquid level can be double checked with the two sensors. Even if one sensor malfunctions or is broken, the liquid level can still be detected by the remaining sensor. Furthermore, the second liquid level sensors 82-1 and 82-2 may detect the liquid level at a position higher than the detection range of the first liquid level sensors 80-1 and 80-2.

Figure 13:
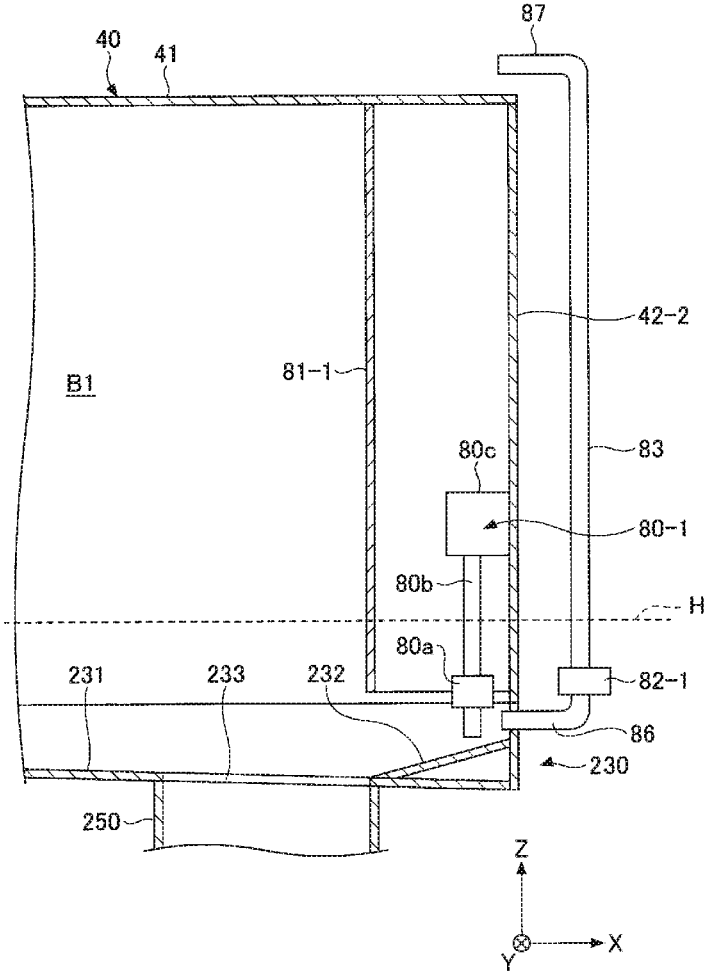
FIG. 13 is a cross sectional view taken along a line XIII-XIII of FIG. 12.

Now, with reference to FIG. 13, the first liquid level sensor 80-1 and the second liquid level sensor 82-1 in a pair will be explained. Since the other pair of the first liquid level sensor 80-2 and the second liquid level sensor 82-2 have the same configuration, redundant description thereof will be omitted.

The grinding apparatus 1 is equipped with, at an outside of the housing 40, a vertical pipe 83 communicating with the inside of the housing 40. A horizontal pipe 86 extending from a lower end of the vertical pipe 83 is inserted into the gutter 230, for example. The horizontal pipe 87 extending from an upper end of the vertical pipe 83 is disposed above the top panel 41 of the housing 40, for example.

Exterior air enters the vertical pipe 83. Therefore, the liquid level of the liquid within the pipe 83 becomes equal to the liquid level of the liquid within the housing 40. The second liquid level sensor 82-1 is mounted to the vertical pipe 83 and serves to detect the liquid level of the liquid within the vertical pipe 83.

Unlike the first liquid level sensor 80-1, the second liquid level sensor 82-1 is disposed outside the housing 40. Therefore, it is possible to suppress the contaminated liquid from being scattered to the second liquid level sensor 82-1, so that malfunction and breakdown of the second liquid level sensor 82-1 can be suppressed.

The first liquid level sensor 80-1 includes a displacement meter configured to measure a displacement of the liquid level. For example, the first liquid level sensor 80-1 has a float 80*a* configured to move up and down according to the fluctuation of the liquid level, a guide 80*b* of the float 80*a*, and a displacement meter 80*c* configured to measure a displacement of the float 80*a*. Here, the displacement meter is not limited to the float type. The displacement meter continuously measures the height of the liquid level within a predetermined range.

Meanwhile, the second liquid level sensor 82-1 includes a switch configured to detect the arrival of the liquid level to a set value. The switch is, by way of example, a proximity switch. Although the way how the proximity switch is operated is not particularly limited, it may be of an optical type. The optical proximity switch detects light transmitted through the transparent vertical pipe 83 and detects the arrival of the liquid level to the set value based on a variation in the amount of the light. Further, the proximity switch may be of a capacitive type or the like. In this case, the vertical pipe 83 may be opaque. By using the second liquid level sensor 82-1 of the type different from that of the first liquid level sensor 80-1, it is possible to avoid a risk that the two sensors malfunction or are broken down at the same time.

The switch of the second liquid level sensor 82-1 includes a switch configured to detect the arrival of the liquid level to the set value. The set value of the liquid level may be lower than a height H of a top 201 (see FIG. 10A) of the two inclined surfaces 210 and 220 combined in the mountain shape. Clogging of the outlets 233 and 243 can be detected before the flow along the inclined surfaces 210 and 220 disappear and the grinding residue begins to be deposited.

As shown in FIG. 12, the grinding apparatus 1 may have a corner cover 84 covering the corner CR3 in addition to the sensor covers 81-1 and 81-2. The corner cover 84 has a slanting plate 84*a* inclined with respect to each of the two side panels 42-3 and 42-4 forming the corner CR3. By hiding the corner CR3 with the slanting plate 84*a*, it is possible to suppress the contaminant from being gathered at the corner CR3. The corner cover 84 does not need to be provided in the carry-in/out chamber B0.

Moreover, the grinding apparatus 1 may have a second corner cover 85 covering a corner between the side panel 42 and the fixed partition wall 45. The second corner cover 85 has a second slanting plate 85*a* that is inclined with respect to each of the side panel 42 and the fixed partition wall 45. By hiding the corner with the second slanting plate 85*a*, the contaminant can be suppressed from being gathered at the corner. The second corner cover 85 is provided in the first grinding chamber B1, the second grinding chamber B2, and the third grinding chamber B3. The second corner cover 85 does not need to be provided in the carry-in/out chamber B0.

Figure 14B:
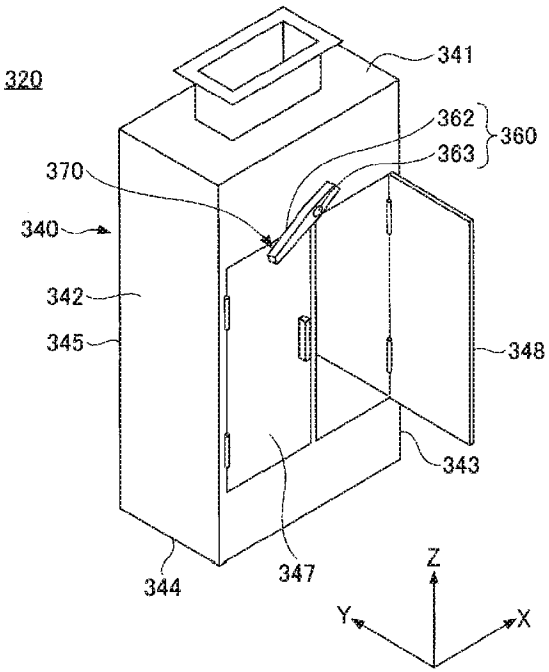
FIG. 14B is a perspective view illustrating an example of a collecting unit.
Figure 14A:
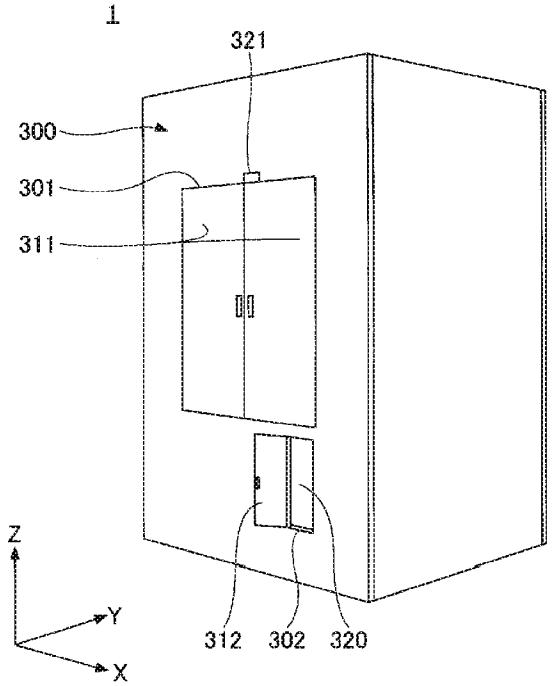
FIG. 14A is a perspective view illustrating an example of an exterior of the grinding apparatus.

As depicted in FIG. 14A, the grinding apparatus 1 is equipped with a case 300 forming an outer surface of the grinding apparatus 1. The case 300 accommodates the table 10, the chuck 20, the chuck driving unit 19, the tool driving unit 30, the housing 40, and a collecting unit 320 therein. The collecting unit 320 collects the grinding residue. The grinding residue flows into the collecting unit 320 along with a liquid such as the grinding liquid, for example. The collecting unit 320 separates the liquid from the grinding residue and drains the liquid, leaving the grinding residue. Details of the collecting unit 320 will be described later.

A first opening 301 and a second opening 302 are separately formed in the case 300. The first opening 301 allows a worker or a working robot to access the chuck 20 or the tool driving unit 30 from the outside of the grinding apparatus 1. Meanwhile, the second opening 302 allows the worker or the working robot to access the collecting unit 320 from the outside of the grinding apparatus 1.

The grinding apparatus 1 is equipped with a first door 311 configured to open or close the first opening 301; and a second door 312 configured to open or close the second opening 302 and provided separately from the first door 311. The worker or the working robot operates the first door 311 to open or close the first opening 301. Likewise, the worker or the working robot operates the second door 312 to open or close the second opening 302.

According to the present exemplary embodiment, the first opening 301 and the second opening 302 are separately formed in the outer surface of the grinding apparatus 1. The second opening 302 is formed closer to the collecting unit 320 than the first opening 301 is. As a result, when the worker or the working robot access the collecting unit 320, the worker or the working robot does not need to operate the first door 311 to open the first opening 301. Therefore, the worker or the working robot need not come into contact with the chuck 20 or the tool driving unit 30. Therefore, while the chuck 20 and the grinding tool D are being driven, the grinding residue can be taken out of the grinding apparatus 1 without stopping the grinding of the substrate W. That is, the grinding residue can be taken to the outside of the grinding apparatus 1 during the grinding of the substrate W.

The first opening 301 and the second opening 302 are formed in the same side surface of the grinding apparatus 1, for example. The first opening 301 and the second opening 302 may be formed in the opposite side surface of the grinding apparatus 1 as well, and the first opening 301 and the second opening 302 may be plural in number. Further, the collecting unit 320 may also be plural in number. The collecting unit 320 is located below the housing 40 shown in FIG. 13 and the like, and serves to collect the grinding residue falling from the outlets 233 and 243 of the housing 40.

As illustrated in FIG. 14A, the grinding apparatus 1 includes a door sensor 321 configured to detect the opening of the first opening 301 by the first door 311. Although the door sensor 321 is not particularly limited, it may be, for example, a proximity switch. When the door sensor 321 detects the opening of the first opening 301, it transmits a signal indicating the opening of the first opening 301 to the controller 16 (see FIG. 1).

When the opening of the first opening 301 is detected by the door sensor 321 while the chuck 20 and the grinding tool D are being driven, the controller 16 stops the driving of the chuck 20 and the grinding tool D. Likewise, if the opening of the first opening 301 is detected by the door sensor 321 during the driving of the table 10, the controller 16 stops the driving of the table 10. Thus, a contact between the component being driven and the worker or the working robot can be suppressed.

Meanwhile, even if the second door 312 opens the second opening 302 during the driving of the chuck 20 and the grinding tool D, the controller 16 carries on the driving of the chuck 20 and the grinding tool D. Likewise, even if the second door 312 opens the second opening 302 during the driving of the table 10, the controller 16 carries on the driving of the table 10. The grinding of the substrate W does not need to be stopped in order to take out the grinding residue to the outside of the grinding apparatus 1.

As described above, even if the second door 312 opens the second opening 302, the controller 16 carries on the driving of the components. Therefore, a door sensor for detecting the opening of the second opening 302 does not need to be provided.

As shown in FIG. 14B, the collecting unit 320 includes walls 341, 342, 343, 344, and 345 that restrict access to the chuck 20 or the tool driving unit 30 through the second opening 302. The walls 341, 342, 343, 344, and 345 form a box 340. The box 340 is open toward the second opening 302.

Figure 15B:
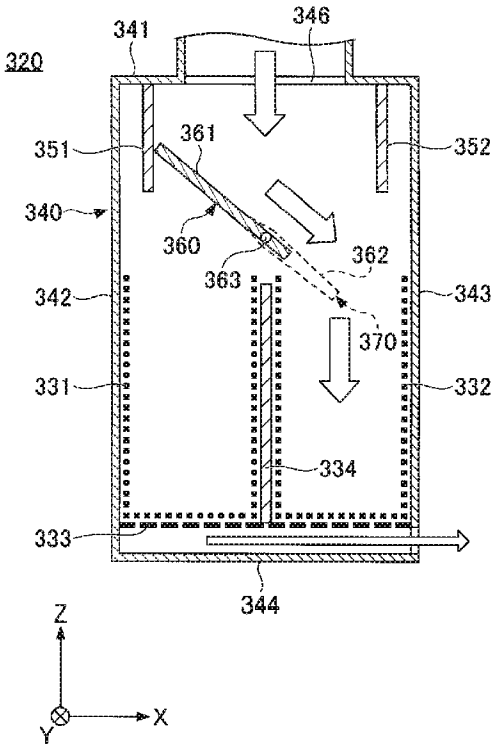
FIG. 15B is a cross sectional view illustrating an example of the storage for the grinding residue after being switched.
Figure 15A:
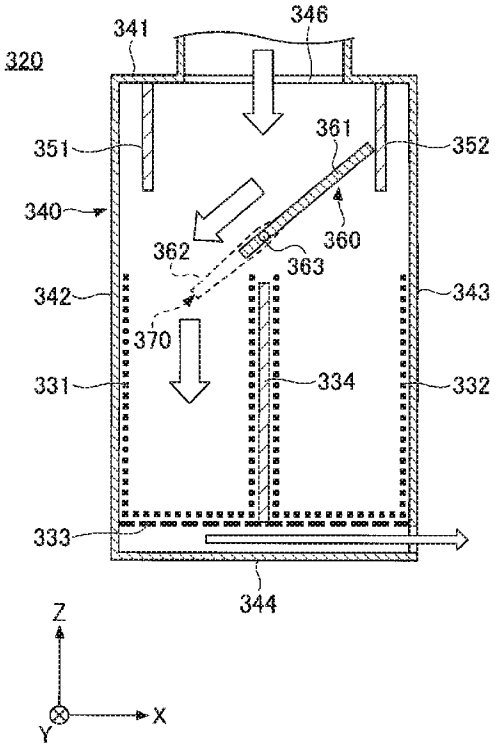
FIG. 15A is a cross sectional view illustrating an example of a storage for the grinding residue.

As illustrated in FIG. 15A and FIG. 15B, an inlet 346 for the grinding residue is formed in the wall 341, which is a ceiling of the box 340. The inlet 346 communicates with the outlet 233 or 243 of the housing 40 via the pipe 250 or 260. The inlet 346 may communicate with both outlets 233 and 243 via both pipes 250 and 260. The grinding residue passes through the inlet 346 of the box 340 and falls down into the box 340.

The collecting unit 320 may have, inside the box 340, a pair of guide walls 351 and 352 for guiding the grinding residue falling from the inlet 346 of the box 340.

As depicted in FIG. 15A and FIG. 15B, the collecting unit 320 includes a plurality of containers 331 and 332 that store the grinding residue therein. The plurality of containers 331 and 332 are individually separable from the inside of the box 340. For example, one container 332 may be separated and emptied while collecting the grinding residue in the other container 331. However, the number of the container may be one.

As shown in FIG. 14B, the box 340 has doors 347 and 348 configured to open or close outlets of the containers 331 and 332. The doors 347 and 348 are different from the second door 312, but they may also serve as the second door 312. The worker or the working robot opens the door 347 (348) and takes the container 331 (332) out of the box 340. Then, the worker or the working robot returns the empty container 331 (332) to the inside of the box 340 and closes the door 347 (348).

As illustrated in FIG. 15A and FIG. 15B, the collecting unit 320 includes a switching mechanism 360 configured to switch a storage destination of the grinding residue. The switching mechanism 360 has, for example, a rotary plate 361 and a manipulation lever 362. The rotary plate 361 is located in a passage through which the grinding residue falls down, and is inclined. The manipulation lever 362 rotates the rotary plate 361 to change the inclination direction of the rotary plate 361. By switching the inclination direction of the rotary plate 361, the storage destination of the grinding residue can be switched.

A rotation diameter of the rotary plate 361 is larger than a distance between the pair of guide walls 351 and 352. The pair of guide walls 351 and 352 are provided in a rotation range of the rotary plate 361. The pair of guide walls 351 and 352 also have a function of a stopper for stopping the rotation of the rotary plate 361. A rotation shaft 363 of the rotary plate 361 is horizontally disposed and is located directly below a midpoint between the pair of guide walls 351 and 352 in a horizontal direction.

As shown in FIG. 15A, the rotating plate 361 is tilted downwards to the left in the state that it is in contact with the guide wall 352 on the right side, allowing the grinding residue to fall into the container 331 on the left side. In this case, the container 331 on the left is the storage destination of the grinding residue.

Meanwhile, as shown in FIG. 15B, the rotary plate 361 is tilted downwards to the right in the state that it is in contact with the guide wall 351 on the left side, allowing the grinding residue to fall into the container 332 on the right side. In this case, the container 332 on the right is the storage destination of the grinding residue.

The collecting unit 320 includes a locking mechanism 370. The locking mechanism 370 restricts the separation of the container 331, which is the corresponding storage destination for the grinding residue, while allowing the separation of the other container 332. Alternatively, the locking mechanism 370 restricts the separation of the container 332, which is the storage destination for the corresponding grinding residue, while allowing the separation of the other container 331. Thus, it is possible to suppress the container as the storage destination of the grinding residue from being accidentally separated while the grinding residue is being stored therein. Thus, scattering of the grinding residue in the box 340 can be suppressed.

As an example of the locking mechanism 370, the manipulation lever 362 of the switching mechanism 360 is used. For example, the manipulation lever 362 extends in a straight line shape from the rotation shaft 363 of the rotary plate 361 to a passage of the container, and restricts the take-out of the container. By way of example, the manipulation lever 362 restricts the take-out of the container 331 by pressing the door 347, as shown in FIG. 14B. Further, the manipulation lever 362 restricts the take-out of the other container 332 by pressing the other door 348. The manipulation lever 362 is switched between a state in which it presses only the door 347 and a state in which it presses only the other door 348. If the manipulation lever 362 is the locking mechanism 370, the door to be locked can be switched at the same time as the storage destination of the grinding residue is switched. Thus, it can be suppressed to forget to switch the door to be locked.

Each of the containers 331 and 332 includes a net to separate the liquid from the grinding residue while leaving the grinding residue. Here, the containers 331 and 332 are entirely mesh baskets. However, only a bottom wall thereof may be formed of the mesh basket. The collecting unit 320 includes a net-shaped placement member 333 that supports the containers 331 and 332 from below while allowing the liquid to fall down therethrough. Above the placement member 333, a partition plate 334 for separating the adjacent containers 331 and 332 may be provided. After the liquid drips from the containers 331 and 332, it passes through the placement member 333 and is drained to the outside of the collecting unit 320. Since only the grinding residue can be left within the collecting unit 320, the frequency of taking out the containers 331 and 332 from the box 340 can be reduced.

So far, the grinding apparatus and the grinding method according to the present disclosure have been described. However, the present disclosure is not limited to the above-described exemplary embodiment or the like. Various changes, corrections, replacements, addition, deletion and combinations may be made within the scope of the claims, and all of these are included in the scope of the inventive concept of the present disclosure.

For example, the number of the tool driving units 30 may be one or more. In addition, the number of the chucks 20 only needs to be larger than the number of the tool driving units 30. In addition, although the inside of the housing 40 is partitioned into the four rooms B0 to B3 by the fixed partition wall 45, the number of the rooms is not limited to four but may be two or more.

This application claims priority to Japanese Patent Application No. 2020-161264, field on Sep. 25, 2020, which application is hereby incorporated by reference in their entirety.

According to the exemplary embodiments, it is possible to suppress malfunction and breakdown of the liquid level sensor located inside the housing.

I claim:

1. A grinding apparatus, comprising:

a chuck configured to hold a substrate;

a housing accommodating the chuck therein, the housing comprising a top panel located above the chuck, and a side panel located on a side of the chuck;

a case forming an outer surface of the grinding apparatus, and accommodating the housing therein;

a tool driving unit configured to drive a grinding tool pressed against the substrate within the housing, the tool driving unit including a moving unit to which the grinding tool is mounted, and an elevating unit configured to move the moving unit up and down;

a nozzle configured to supply a grinding liquid to the substrate within the housing;

a sensor, disposed at an inside of the housing, configured to detect a liquid level of a liquid collected within the housing; and a sensor cover located between the chuck and the sensor, wherein an insertion opening for the moving unit is formed at the top panel which is located above the side panel, wherein the housing includes multiple side panels located on a side of the chuck, wherein the sensor is located at a corner between the multiple side panels, wherein when viewed from above, the sensor cover comprises a slanting plate inclined with respect to each of the multiple side panels forming the corner, and wherein the sensor is located in a space surrounded by the multiple side panels and the slanting plate.

2. The grinding apparatus of claim 1, wherein the housing includes a pan disposed under the chuck to receive the grinding liquid and a grinding residue that are falling down, wherein the pan comprises a gutter at an edge thereof, and wherein when viewed from above, the sensor overlaps the gutter.

3. The grinding apparatus of claim 2, wherein the chuck is implemented as a plurality of chucks, the gutter is implemented as two gutters, and the sensor is implemented as a plurality of sensors, wherein the grinding apparatus further comprises:

a table, holding the plurality of chucks around a rotation center line, configured to be rotated about the rotation center line; and a fixed partition wall that divides the inside of the housing into four rooms around the rotation center line of the table, wherein the pan comprises, on a top surface thereof, two inclined surfaces that are inclined downwards as the two inclined surfaces go away from a boundary between two of the rooms adjacent to each other and remaining two rooms, wherein the pan comprises the two gutters along lower edges of the two inclined surfaces, and wherein when viewed from above, a first one of the plurality of sensors overlaps a first one of the two gutters, and a second one of the plurality of sensors overlaps a second one of the two gutters.

4. The grinding apparatus of claim 2, wherein the gutter comprises, at a lowermost portion of a bottom thereof, an outlet through which the grinding liquid and the grinding residue are drained, and wherein when viewed from above, the sensor is located near the outlet.

5. The grinding apparatus of claim 1, further comprising:

a second sensor configured to detect, apart from the sensor, the liquid level.

6. The grinding apparatus of claim 5, further comprising:

a vertical pipe, disposed at an outside of the housing, communicating with the inside of the housing, wherein the second sensor is mounted to the vertical pipe.

7. The grinding apparatus of claim 5, wherein the sensor includes a displacement meter configured to measure a displacement of the liquid level, and wherein the second sensor includes a switch configured to detect an arrival of the liquid level to a set value.

8. The grinding apparatus of claim 7, wherein the chuck is implemented as a plurality of chucks, wherein the grinding apparatus further comprises:

a table, holding the plurality of chucks around a rotation center line, configured to be rotated about the rotation center line; and a fixed partition wall that divides the inside of the housing into four rooms around the rotation center line of the table, wherein the housing includes a pan disposed under the plurality of chucks to receive the grinding liquid and a grinding residue that are falling down, wherein the pan comprises, on a top surface thereof, two inclined surfaces that are inclined downwards as the two inclined surfaces go away from a boundary between two of the rooms adjacent to each other and remaining two rooms, and wherein the set value of the liquid level is lower than a height of a top of the two inclined surfaces.

9. A grinding apparatus, comprising:

a chuck configured to hold a substrate;

a housing accommodating the chuck therein;

a tool driving unit configured to drive a grinding tool pressed against the substrate within the housing;

a nozzle configured to supply a grinding liquid to the substrate within the housing;

a sensor, disposed at an inside of the housing, configured to detect a liquid level of a liquid collected within the housing; and a sensor cover located between the chuck and the sensor, wherein the housing includes multiple side panels located on a side of the chuck, wherein the sensor is located at a corner between the multiple side panels, wherein when viewed from above, the sensor cover comprises a slanting plate inclined with respect to each of the multiple side panels forming the corner, and wherein the sensor is located in a space surrounded by the multiple side panels and the slanting plate.

* * * * *